US007003863B2

(12) United States Patent
Skov et al.

(10) Patent No.: US 7,003,863 B2
(45) Date of Patent: Feb. 28, 2006

(54) APPARATUS AND METHOD FOR MOUNTING ACCESSORY DEVICES TO PANELS

(75) Inventors: Erik L. Skov, Akron, OH (US); William F. Croft, Wooster, OH (US); Timothy M. Pierzynski, Wooster, OH (US); David M. Stitchick, Wooster, OH (US)

(73) Assignee: Rubbermaid Incorporated, Wooster, OH (US)

( * ) Notice: Subject to any disclaimer, the term of this patent is extended or adjusted under 35 U.S.C. 154(b) by 135 days.

(21) Appl. No.: 10/127,949

(22) Filed: Apr. 23, 2002

(65) Prior Publication Data

US 2002/0174532 A1 Nov. 28, 2002

Related U.S. Application Data

(63) Continuation-in-part of application No. 10/082,608, filed on Feb. 25, 2002, now Pat. No. 6,668,514, and a continuation-in-part of application No. 09/860,381, filed on May 18, 2001, now Pat. No. 6,701,678.

(51) Int. Cl.
*B23P 11/02* (2006.01)
*E04B 2/74* (2006.01)

(52) U.S. Cl. ..... 29/453; 29/897.3; 29/897.32; 52/36.4; 52/36.5

(58) Field of Classification Search ..... 29/897.32, 29/897.3, 897, 453; 52/36.4, 36.5, 36.6, 79.1
See application file for complete search history.

(56) References Cited

U.S. PATENT DOCUMENTS 603,147 A 4/1898 Lordly ..... 189/36
1,800,386 A 4/1931 Hoffman
2,079,635 A 5/1937 Sharp ..... 189/34
2,270,161 A 1/1942 Briggs ..... 189/2

(Continued)

FOREIGN PATENT DOCUMENTS

CH 396 368 1/1966
DE 26 43 270 A1 3/1978
DE 34 18687 A1 11/1985

(Continued)

OTHER PUBLICATIONS

"item Industrietechnik" promotional materials, bearing a designation 0.4.106.31 May 1995 (13 pages).
International Search Report for PCT/US02/15630 dated Sep. 20, 2002.
PCT International Search Report issued in PCT/US03/05417, Jun. 24, 2003.
PCT International Written Opinion issued in PCT/US03/05417, mailed Nov. 12, 2003.
PCT International Preliminary Examination Report (IPER) issued in PCT/US03/05417 on Apr. 15, 2004.

*Primary Examiner*—Essama Omgba
(74) *Attorney, Agent, or Firm*—Marshall, Gerstein & Borun LLP

(57) ABSTRACT

An apparatus for mounting accessories to a panel surface includes at least one accessory interface on the panel surface. An elongate engaging section is recessed within and lies generally parallel to a part of the panel surface. An accessory device has a utility part and an elongate engaging part that is coupled to the utility part. A plurality of the accessory devices and/or accessory interfaces can be provided. An appropriate device and interface are selected. The engaging part is inserted into a portion of the panel interface. The accessory device is slid to an installed position with the engaging part received in the engaging section of the accessory interface.

40 Claims, 18 Drawing Sheets

U.S. PATENT DOCUMENTS

| | | | | | |
|---|---|---|---|---|---|
| 2,981,383 | A | | 4/1961 | Dunn | 189/36 |
| 3,070,646 | A | | 12/1962 | Lindgren | 174/35 |
| 3,381,430 | A | | 5/1968 | Wiczer | 52/28 |
| 3,436,881 | A | | 4/1969 | Schlecht | 52/92 |
| 3,452,501 | A | | 7/1969 | Zimmer et al. | 52/625 |
| 3,513,608 | A | | 5/1970 | Nagrod | 52/82 |
| 3,516,216 | A | | 6/1970 | Galloway | 52/731 |
| 3,543,456 | A | | 12/1970 | Gregoire | 52/72 |
| 3,638,385 | A | | 2/1972 | Nobels et al. | 52/665 |
| 3,640,039 | A | | 2/1972 | McKee et al. | 52/281 |
| 3,675,380 | A | | 7/1972 | Moss | 52/80 |
| 3,820,299 | A | | 6/1974 | Verholt | 52/753 |
| 3,854,269 | A | | 12/1974 | Hancock | 52/754 |
| 3,862,524 | A | * | 1/1975 | McCrackin | 52/36.4 |
| 3,866,381 | A | | 2/1975 | Eschbach et al. | 52/731 |
| 3,992,839 | A | | 11/1976 | La Borde | 52/275 |
| 4,258,519 | A | | 3/1981 | Hugens | 52/282 |
| 4,294,051 | A | | 10/1981 | Hughes, Jr. | 52/228 |
| 4,447,099 | A | | 5/1984 | French et al. | 312/257 |
| 4,557,091 | A | | 12/1985 | Auer | 52/282 |
| 4,652,170 | A | | 3/1987 | Lew | 403/381 |
| 4,674,240 | A | * | 6/1987 | Strausheim | 52/36.4 |
| 4,731,960 | A | * | 3/1988 | Sease | 52/36.6 |
| 4,805,365 | A | | 2/1989 | Bastian | 52/282 |
| 5,018,323 | A | * | 5/1991 | Clausen | 52/36.4 |
| 5,036,634 | A | | 8/1991 | Lessard et al. | 52/79.1 |
| 5,138,803 | A | * | 8/1992 | Grossen | 52/36.4 |
| 5,142,832 | A | * | 9/1992 | Branham et al. | 52/36.4 |
| 5,155,961 | A | | 10/1992 | Bardo | 52/646 |
| 5,184,436 | A | | 2/1993 | Sadler | 52/79.1 |
| 5,241,796 | A | * | 9/1993 | Hellwig et al. | 52/36.4 |
| 5,331,778 | A | | 7/1994 | Mazpule et al. | 52/79.5 |
| 5,398,909 | A | | 3/1995 | Sandwith | 249/207 |
| 5,413,236 | A | | 5/1995 | Kenevan | 220/4.28 |
| 5,529,423 | A | | 6/1996 | Burke et al. | 403/218 |
| 5,575,119 | A | | 11/1996 | Wolfowitz | 52/79.1 |
| 5,592,794 | A | | 1/1997 | Tundaun | 52/220.7 |
| 5,622,010 | A | | 4/1997 | Weber | 52/36.1 |
| 5,647,181 | A | | 7/1997 | Hunts | 52/282.1 |
| 5,657,885 | A | * | 8/1997 | White et al. | 211/87.01 |
| 5,664,380 | A | | 9/1997 | Hsueh | 52/126.4 |
| 5,673,531 | A | | 10/1997 | Carcedo et al. | 52/656.9 |
| 5,724,774 | A | | 3/1998 | Rooney | 52/79.5 |
| 5,775,046 | A | | 7/1998 | Fanger et al. | 52/590.1 |
| 5,803,274 | A | * | 9/1998 | Scheveloff | 211/87.01 |
| 5,813,738 | A | | 9/1998 | Cheng | 312/263 |
| 5,864,997 | A | | 2/1999 | Kelly | 52/282.2 |
| 5,931,429 | A | * | 8/1999 | Hellwig et al. | 248/235 |
| 5,941,026 | A | | 8/1999 | Eisenreich et al. | 52/36.5 |
| 5,944,294 | A | * | 8/1999 | Baer | 248/220.43 |
| D420,838 | S | | 2/2000 | Riga | 248/235 |
| 6,047,663 | A | | 4/2000 | Moreau et al. | 119/529 |
| 6,053,591 | A | | 4/2000 | Kasanic | 312/297 |
| 6,105,794 | A | * | 8/2000 | Bauer | 211/94.01 |
| 6,185,878 | B1 | | 2/2001 | Bullard, III et al. | 52/79.5 |
| 6,349,507 | B1 | * | 2/2002 | Muellerleile | 52/36.5 |
| 6,357,194 | B1 | | 3/2002 | Jones, Jr. | 52/590.1 |

FOREIGN PATENT DOCUMENTS

| | | | | |
|---|---|---|---|---|
| DE | 8913507.5 | | | 3/1990 |
| DE | 3843151 | | | 7/1990 |
| EP | 0359309 | A3 | | 3/1990 |
| EP | 0 675 332 | A | | 10/1995 |
| EP | 675332 | A2 | * | 10/1995 |
| FR | 1 028 791 | | | 5/1953 |
| FR | 1 311 988 | | | 11/1962 |
| FR | 1 447 663 | | | 6/1966 |
| FR | 2636654 | A1 | * | 3/1990 |
| GB | 1 081 423 | | | 8/1967 |
| GB | 1 2623 95 | | | 2/1975 |
| GB | 2115452 | A | | 9/1983 |
| GB | 2 176 514 | A | | 1/1986 |
| GB | 2281326 | A | | 3/1995 |
| IE | 22203 | | | 7/1959 |
| JP | 4-238954 | | | 1/1991 |
| TW | 86109777 | | | 10/1998 |
| WO | WO 01/38669 | A1 | | 5/2001 |

* cited by examiner

APPARATUS AND METHOD FOR MOUNTING ACCESSORY DEVICES TO PANELS

RELATED APPLICATION DATA

The present patent is a continuation-in-part of U.S. patent application Ser. No. 09/860,381, which was filed on May 18, 2001, now U.S. Pat. No. 6,701,678 and Ser. No. 10/082,608, which was filed on Feb. 25, 2002 now U.S. Pat. No. 6,668,514.

FIELD OF THE INVENTION

The invention is generally related to panel mounted accessory devices, and more particularly to an apparatus and a method for mounting accessory devices to panels.

BACKGROUND OF THE INVENTION

Plastic and other panels are used in many different applications for a wide variety of modular or multi-component products. In many of these applications, a plurality of panels and/or components are interconnected to one another to form a finished product assembly. A number of different structures and methods have been devised that are useful to interconnect or attach two adjacent components to one another. A number of different accessory devices have also been devised that attach or otherwise mount to the panels that are useful for hanging or otherwise suspending objects from the panels.

In one example, a typical panel may provide a plurality of access holes therein. A typical hanger has prongs or hooks that are adapted for receipt in selected ones of the access holes. The prongs or hooks are inserted in the selected holes to suspend the hanger from the panel. In other examples, hangers, hooks, or mounting brackets are simply fastened to a panel utilizing conventional fasteners such as screws, bolts, or the like.

Problems associated with such accessory devices and mounting methods are abundant. Conventional threaded fasteners result in use of a number of component parts (nuts, bolts, washers, and the like) that can be easily lost or misplaced and that require significant labor to install. The hook-on accessory devices typically hang relatively loosely and, thus, can be easily dislodged and do not provide a sturdy mount for hanging objects. The fastener mount accessory devices can easily come loose if not properly fastened. Also, the fasteners can become loosened if the hanger is used over and over again, again resulting in a less than sturdy mount for hanging objects.

BRIEF DESCRIPTION OF THE DRAWINGS

Exemplary mounting apparatuses and mounting methods in accordance with the teachings of the present invention are described and explained in greater detail below with the aid of the drawing figures in which.

DETAILED DESCRIPTION OF THE PREFERRED EMBODIMENTS

Figure 1:
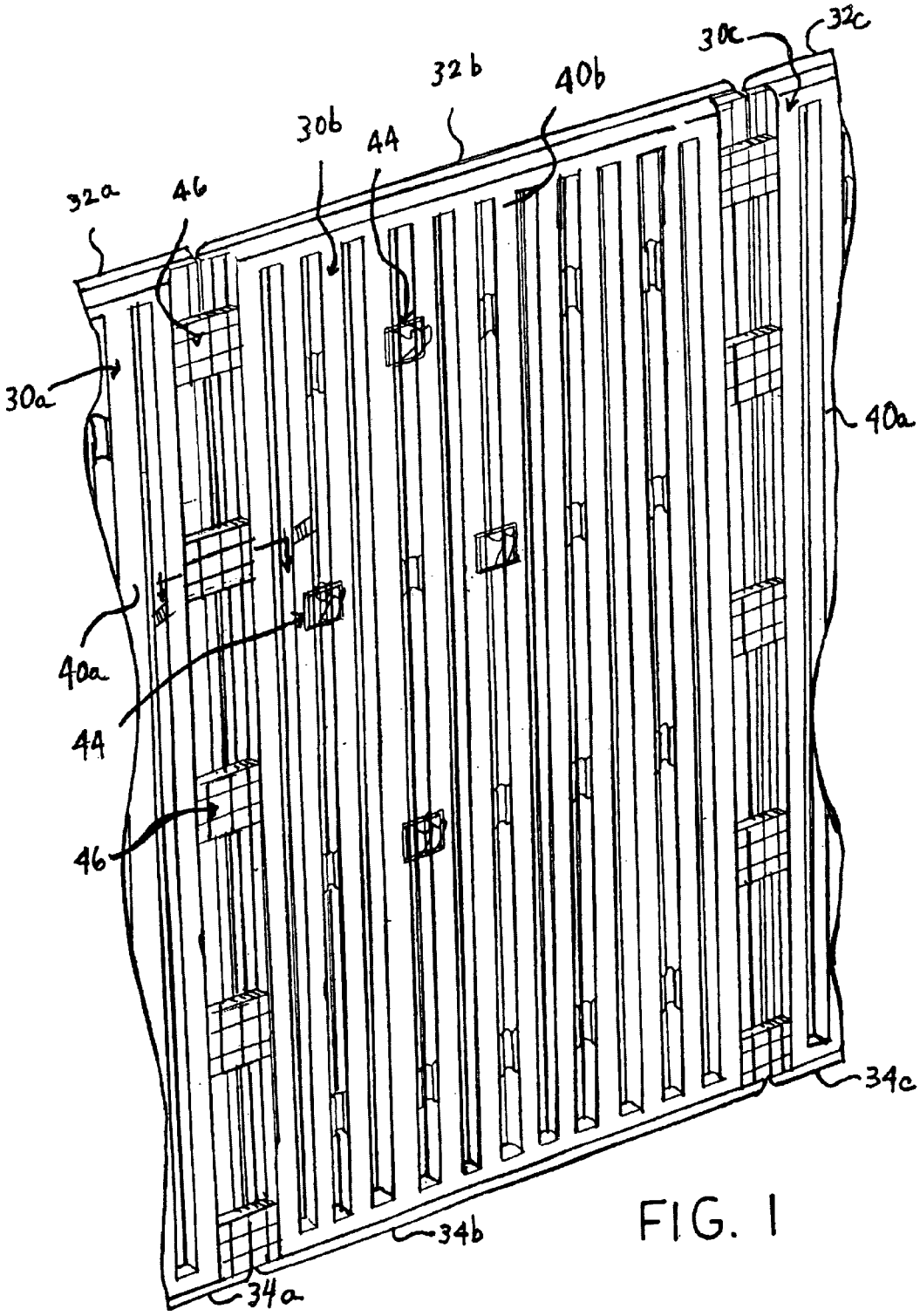
FIG. 1 is a perspective view of one example of a plurality of adjacent panels interconnected in accordance with the teachings of the present invention.

The disclosed apparatuses and methods for mounting accessory devices to a panel solve or improve upon the above-mentioned problems in the prior art. The disclosed apparatuses and methods are especially well suited for mounting accessory devices to plastic panels, although they can be easily adapted for use with other panel materials, if desired. A sturdy mounted accessory device and method is disclosed and described that utilizes no mounting fasteners. A portion of an accessory device slides within and interlocks with a portion of a panel to secure the device in place. The disclosed apparatuses and methods for mounting accessory devices render such a device easy to install on a panel and result in a sturdily mounted device that is relatively difficult to dislodge.

Also shown and described herein are an exemplary apparatus and method for interconnecting adjacent panels. The disclosed interconnecting apparatus and method result in panels being connected in a simple, efficient manner. The disclosed apparatus and method for mounting accessory devices generally follow the same principles as the methods and apparatuses described herein for interconnecting two panels. The illustrated accessory installation is strong, secure, and easy to install and can support a wide variety of objects.

In order to simplify the description herein, a general element is given a base reference number. If a number of essentially identical elements are shown or referred to herein, the discrete, identical elements are each given the same base reference number and a unique sub-reference character. As an example, and with reference to FIG. 1, a plurality of interconnected and laterally adjacent plastic panels 30 are illustrated. The panels are generally referred to herein as "panels 30," and are each specifically identified as panels 30*a*, 30*b*, and 30*c* where necessary. In addition, each specific panel has various components and elements associated with that particular panel that are also common to the other panels as well. Such components and elements are similarly identified herein utilizing only the base reference number when generally referring to the object, and utilizing the base reference number and sub-reference character, such as "a" or "b" when referring that object of a specific panel.

Also, terms of orientation, location, or part relationship are used herein, such as "top," "bottom," "front," "back," or other such descriptive terms. Such terms are utilized solely for ease of description and are not intended to specifically limit a component in any way. The panels and other components can be oriented and arranged in virtually any desired manner without being unnecessarily limited or restricted by the use of such terms herein.

As a further preliminary matter, the panels illustrated herein are for a modular shed or storage structure. However, the features of the disclosed examples have a much wider applicability. The panels and the accessory device and its illustrated mounting features can be used for other products including storage devices, units, enclosures, bins, boxes, containers, display panels, boards, totes, and other object storage and organization products. The connectors can be used for any of a variety of containers and the like as well.

The particular materials used to construct the exemplary panels are also illustrative. For example, blow molded, high density polyethylene is one preferred material and method for fabricating the disclosed panels. However, other materials can be used, such as other thermoplastic resins including polypropylene, acrylonitrile butadiene styrene (ABS), polyurethane nylon, homopolymer plastics, copolymer plastics, plastics with special additives, filled plastics, and the like. Also, molding or part forming operations other than blow molding can be used to form the various disclosed components, such as injection molding, rotational molding, and the like.

Further, injection molded, high density polyethylene is a preferred material and method for fabricating the connectors disclosed herein. However, other materials can certainly be used, such as other thermoplastic resins including polypropylene, acrylonitrile butadiene styrene (ABS), polyurethane nylon, homopolymer plastics, copolymer plastics, plastics with special additives, filled plastics, and the like. Still further, other molding operations or part forming operations can be used to form the connector components.

As will be evident to those having ordinary skill in the art, the various parts and components disclosed herein can be formed from other materials such as metal, wood, and the like, if desired and yet fall within the spirit and scope of the present invention. The components can also be fabricated utilizing a variety of manufacturing techniques such as stamping, casting, machining, and the like, as desired.

With the above in mind and with reference to FIG. 1, each of the panels 30 has a top edge 32, a bottom edge 34, a first side edge 36, and a second side edge 38. As described herein, a first side edge 36 of one panel 30 is interconnected or joined to a corresponding second side edge 38 of an adjoining panel. Each of the panels 30 also has a profile side 40 having a surface profile that yields particular characteristics in accordance with the teachings of the present invention. Each of the panels 30 also has what is termed herein as a decorative or cosmetic side 42 that is generally planar. The decorative side 42 need not be adapted to provide particular aesthetics, though in many instances it will be so configured. However, the decorative side 42 does not provide particular features necessary to the apparatus and method as disclosed. One or both of the profile side 40 and the decorative side 42 can be adapted to include features that add rigidity or enhance the structural characteristics of the panels, if desired, though not disclosed herein.

Figure 2:
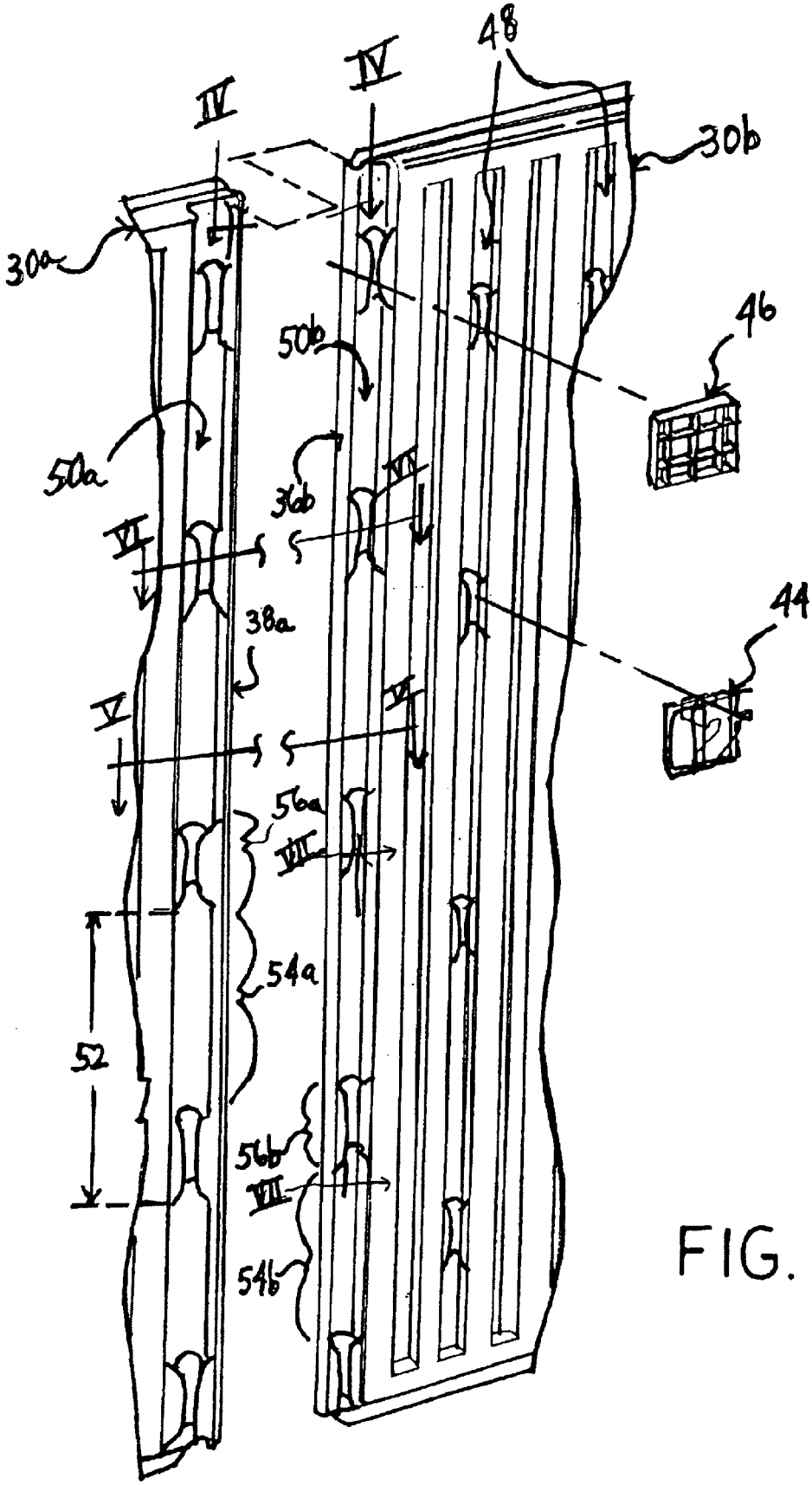
FIG. 2 is an exploded view of two of the interconnected panels as shown in FIG. 1.

In the disclosed example, one or more accessory devices in the form of utility hangers 44 can be mounted to the profile side 40 of each panel. The accessory devices can be added to perform any number of desired functions, such as to provide shelving supports, tool hangers, and the like. As shown in FIG. 2, the utility hangers 44 or other accessory devices can be assembled to numerous different locations as desired on the profile side 40 of a given panel 30. Details of the accessory devices 44 and the structures and methods to mount the devices are described below with reference to FIGS. 14–20.

Details of the various structures and methods to interconnect the panels are now described. In general, a pair of adjacent panels, such as the panels 30*a* and 30*b*, can be interconnected by one or more connectors 46 that engage a portion of the profile side 40 of each adjoining panel. The adjacent panels 30*a* and 30*b* are first attached or interlocked with one another and then secured or connected to one another utilizing one or more of the connectors 46.

As shown in FIGS. 1 and 2, each panel 30 includes at least one connector interface to accept and engage with one of the connectors 46. In the disclosed example, the panels 30 each have a connector interface in the form of an elongate connector channel 50 disposed adjacent each of the side edges 36 and 38. In an alternative example, each panel can have a connector interface, such as a connector channel 50, disposed adjacent only one of the opposed side edges 36 or 38 so that only one of the panel edges is adapted to be joined to an adjacent panel. Depending upon the particular panel construction, a connector interface or channel 50 can be disposed adjacent any or all side, top, bottom, or other edges of a panel, as desired.

As illustrated in FIGS. 1 and 2, each connector channel 50 is a continuous channel having a plurality of discrete channel segments 52. Alternatively, each connector channel 50 can be discontinuous or segmented and define intermittent, discrete channel segments 52 along an appropriate edge of the panel. In another alternative, a connector interface or channel 50 may include only a single segment, as such segments are described herein. Each segment 52 of each channel 50 in the disclosed example has a connector docking section 54 that is adapted for insertion and removal of a portion of a connector 46. Each segment 52 also has a connector engaging section 56 that is adapted for connector installation when securely joining two adjacent panels. Each channel segment is adapted to accommodate, in this example, part of one of the connectors 46 as described below. Details of the channel segments 52 and sections 54 and 56 are also described in greater detail below.

Figure 3:
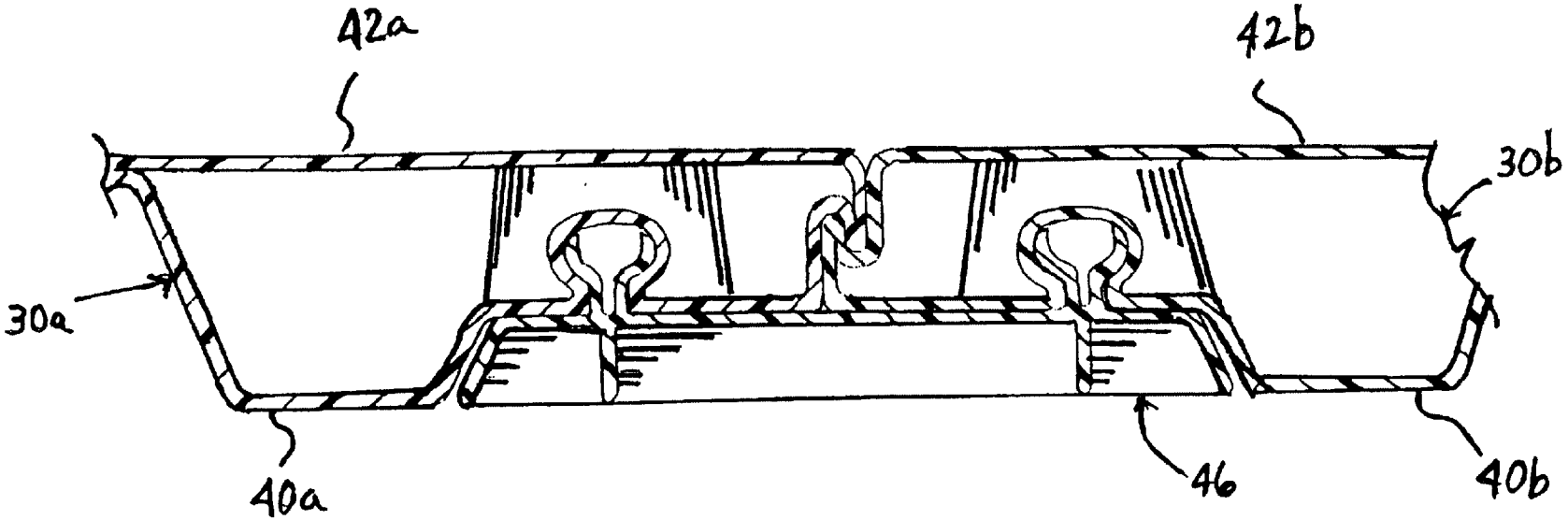
FIG. 3 is a transverse cross section across an interconnected joint between two of the adjacent panels and taken along line III—III of FIG. 1.

As shown in FIG. 3, an apparatus as constructed and engaged in accordance with the teachings of the present invention generally utilizes at least one of the connectors 46 and at least a pair of the connector channel segments, one from each of the two adjacent panels. In this example, the panels 30*a* and 30*b* and thus, a segment 52*a* and 52*b*, are utilized for the engaged apparatus. One of the segments is provided on each of two adjacent panels 30*a* and 30*b* to be connected.

Figure 4:
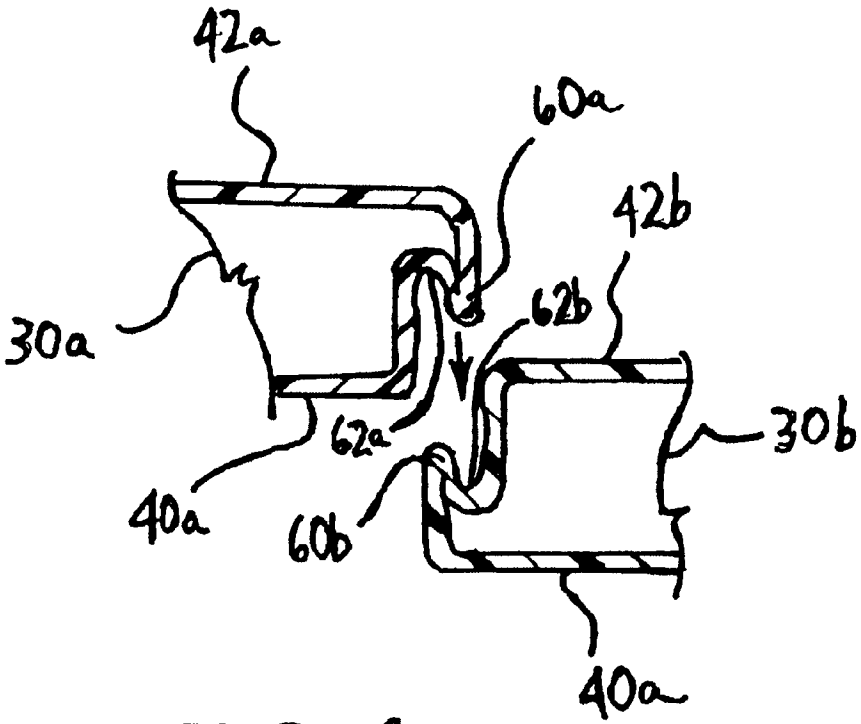
FIG. 4 is a transverse cross section of the two adjacent panel edges shown just prior to attachment to one another and taken generally along line IV—IV in FIG. 2.

Details of both the method and the apparatus in accordance with the teachings of the present invention are described, beginning with reference to FIG. 4. Each of the panels has an interlocking element at all of the edges that are adapted to interconnect with an adjacent panel. The interlocking elements of the panels to be joined are first interlocked to one another. Then a connector is utilized to secure the adjacent panels together.

Figure 5:
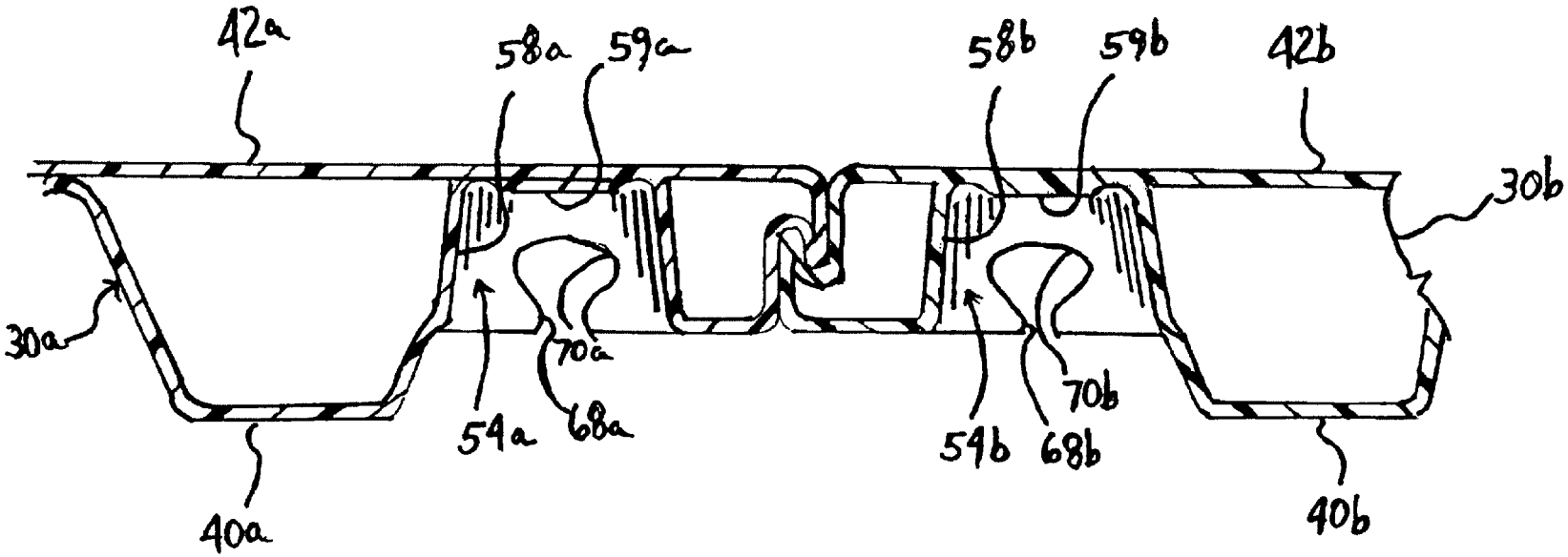
FIG. 5 is a transverse cross section of the joint between the two panel edges shown just after attachment to one another, shown prior to installation of the connector, and taken along line V—V in FIG. 2.

In this disclosed example, each adjacent panel edge to be joined, such as the side edges 38*a* of the panel 30*a* and 36*b* of the panel 30*b*, has an interlocking lip 60*a* and 60*b*, respectively, that extends from the corresponding panel edge. Each lip 60 extends from the panel edge at an angle, and in this example, is generally perpendicular to a plane of the corresponding panel. Each lip 60*a* and 60*b* defines a groove 62*a* and 62*b*, respectively, between the lip and the panel edge. The lips 60 and grooves 62 of the respective panels are arranged in opposite directions so that the lip of one panel is received in and engages the groove of the adjacent panel in an interlocking relationship. For example, as shown in FIGS. 4 and 5, the lip 60*a* of the panel 30*a* is received in the groove 62*b* of the panel 30*b* . Similarly, the lip 60*b* is received in the groove 62*a*.

Once the two adjacent panels, such as the panels 30*a* and 30*b*, are engaged or interlocked in this manner, the two panels, and thus the channels 50*a* and 50*b* are properly spaced apart laterally across the joint. However, the two panels 30*a* and 30*b* should also be aligned longitudinally so as to accommodate installation of a connector 46. In the disclosed example, the connector 46 requires that the corresponding docking sections 54*a* and 54*b* and engaging sections 56*a* and 56*b* of the adjacent channels 50*a* and 50*b* be directly across from one another. In an alternative example, though not shown or described in detail herein, the connector 46 can be designed to require a different, non-mirror image alignment of the adjacent channels 50, if desired.

Figure 6:
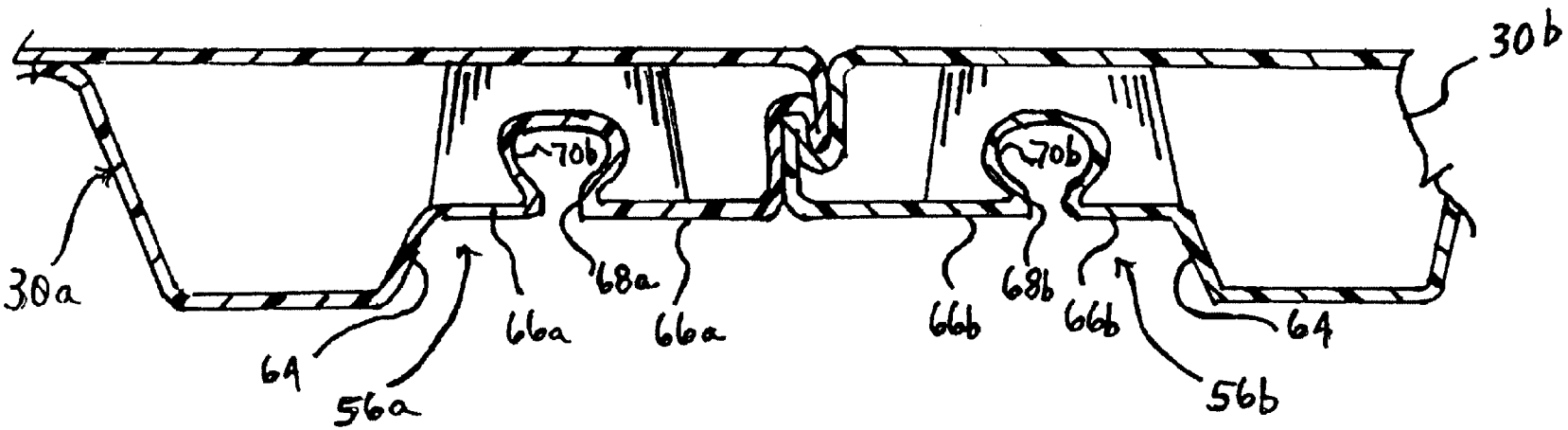
FIG. 6 is a transverse cross section of the joint between the two panel edges shown just after attachment to one another, shown prior to installation of the connector, and taken along line VI—VI in FIG. 2.
Figure 7:
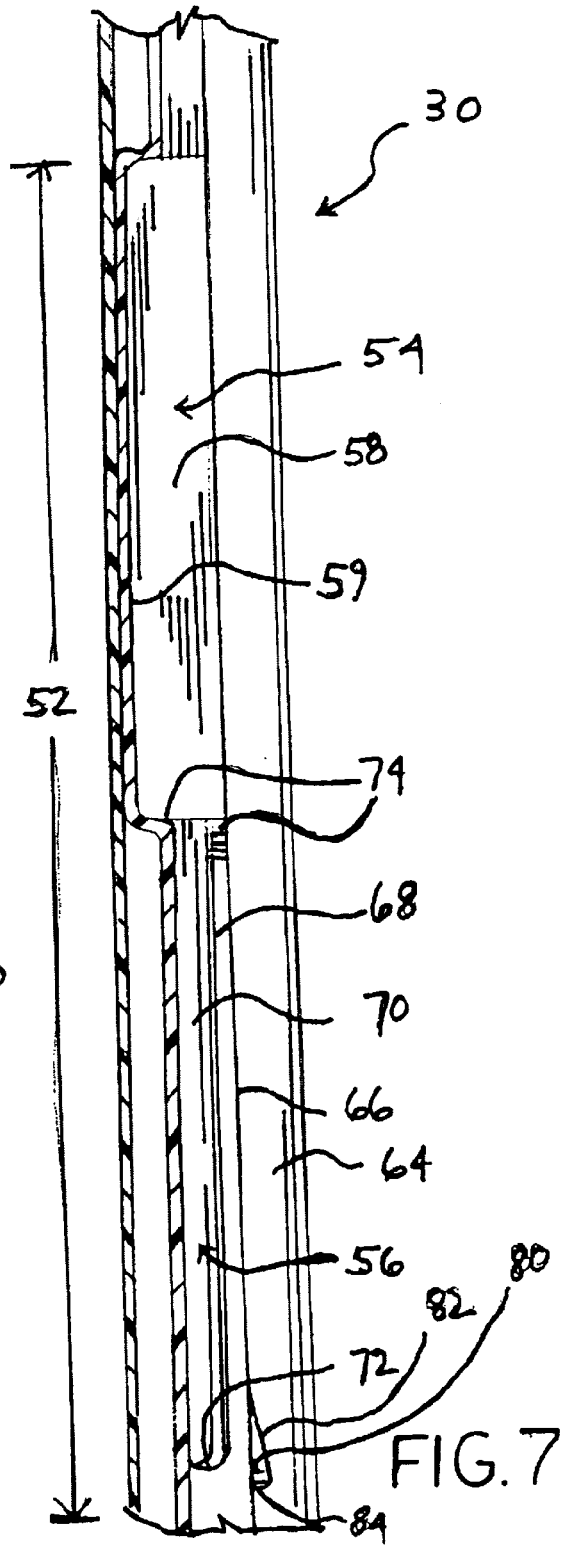
FIG. 7 is a longitudinal cross section of a connector channel of one panel and taken along line VII—VII in FIG. 2.
Figure 9:
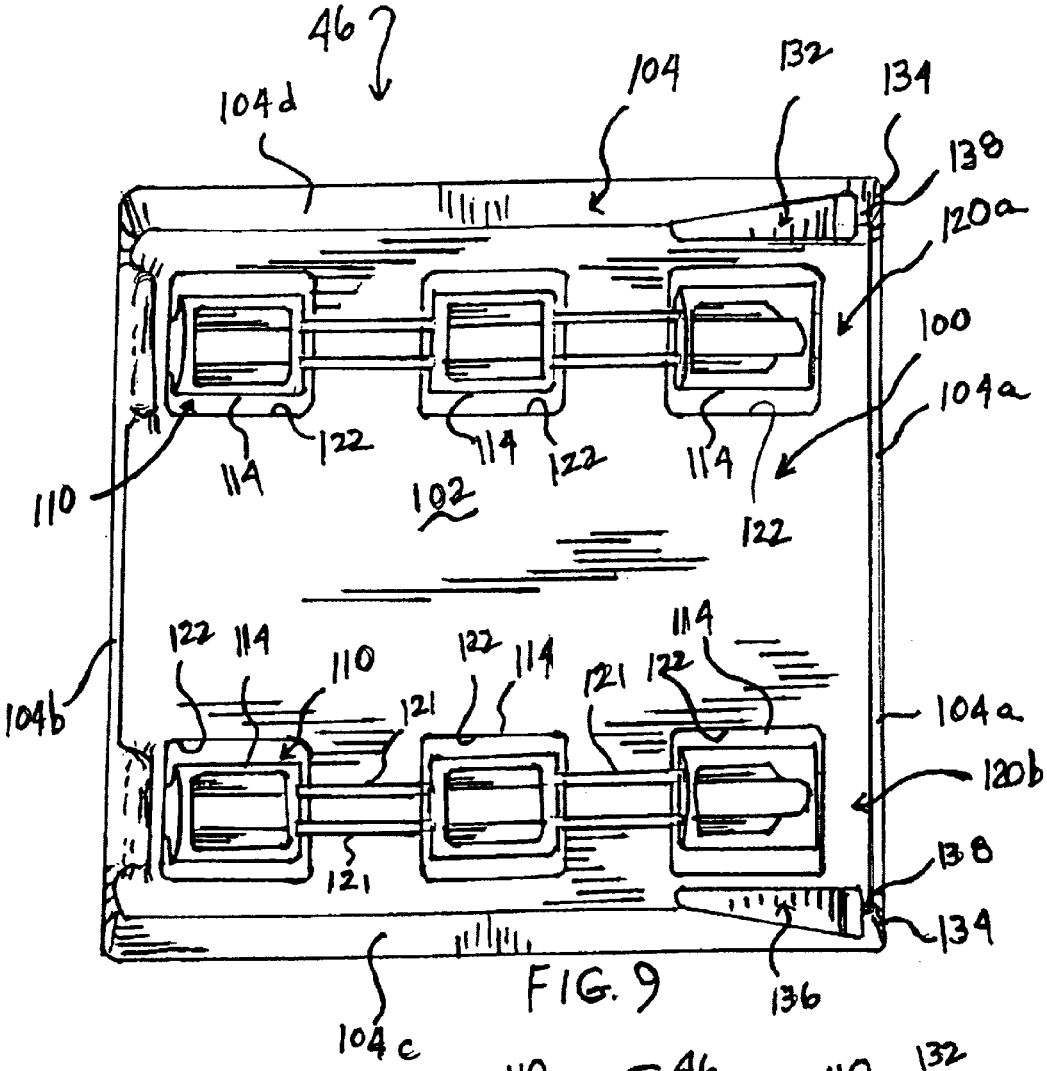
FIG. 9 is a top plan view of the connector shown in FIG. 8.

Details of the channel segments 52 are described with particular reference to FIGS. 5–7. FIG. 5 illustrates a transverse cross section across two engaged panels 30*a* and 30*b* prior to installation of a connector 46, and taken through the properly longitudinally aligned (side-by-side) connector docking sections 54*a* and 54*b*. As shown, each docking section 54 of each channel has a pair of side walls 58 and a bottom wall 59 that define a depth and a width intended to easily accommodate insertion of a connector therein. A connector 46 is placed into the profile side 40 of the engaged panels 30 at the docking sections 54 and readied for installation. In the present example, each docking section 54 also has a length, as illustrated in FIG. 7, that extends between longitudinally adjacent engaging sections 56 of two channel segments 52 in the channel 50. As discussed above, each docking section need not extend continuously to another channel segment, but instead may terminate at a discrete segment end (not shown) if desired. In any case, the docking section 54 must have a length, width, and depth combination that permits adequate insertion of a connector 46 into the docking section to facilitate proper installation and engagement of the connector.

FIG. 6 illustrates a transverse cross section across two engaged panels 30*a* and 30*b*, prior to installation of a connector 46, and taken through the side-by-side connector engaging sections 56*a* and 56*b*. Each connector engaging section 56 of a channel 50 has side walls 64 and a generally planar bearing surface 66. A connector slot 68 is provided in the bearing surface 66 and extends longitudinally along the length of the connector engaging section 56. The connector slot 68 provides access deeper into the engaging section, and particularly, into a connector latching tunnel 70. The width of the connector slot 68 is narrower than the width of the latching tunnel 70 for reasons described in greater detail below. One end of the latching tunnel narrows to define a connector stop surface 72, limiting the travel of a connector when installed. The opposite end of the latching tunnel 70 and connector slot 68 can be tapered slightly radially outward, as shown, to define an entry opening 74 into the connector slot and latching tunnel.

The connector interface of one or both of the adjacent panels can include a detente mechanism to provide a positive fully installed feel or indication. The detente mechanism can also assist in holding a connector in an installed position. In this example, a detent ramp 80 is provided on at least one of the bearing surfaces 66 adjacent the connector slot 68. In the present example, a ramp 80 is provided on the side of the bearing surface 66 furthest from the panel edge so that when the connector 46 is installed, its outer most forward edges each engage a detent ramp to assist in holding the connector in the installed or engaged position. In the present example, the detent ramps 80 each have an inclined ramp surface 82 that can be inclined at a desired angle to make installation of the connector relatively easy. The ramps 80 in this example are located near the forward, narrowed end or stop surfaces 72 of the latching tunnel 70. However, the ramps can alternatively be provided anywhere along the bearing surfaces and yet provide the attendant function. Each ramp surface terminates at its inclined end at a front end 84.

Referring now to FIGS. 8–11, one example of the connector 46 is shown and described. However, as will be evident to those having ordinary skill in the art, many modifications and changes to the disclosed connector 46 can be made without departing from the spirit and scope of the present invention. The connector 46 generally has a base and a pair of engaging parts projecting from the base. The base is sized to span between or traverse the two adjacent panels and to reach the connector interface of each panel. The engaging parts are positioned and constructed such that one of the parts engages with each of the connector interfaces of the panels.

The disclosed connector 46 has a body or base 100, which in this example is generally rectangular, and nearly square. The disclosed base 100 is a molded thermoplastic component having a wall thickness and a structural design sufficient to render the base substantially rigid. In the present example, the base has a top wall or surface 102, an annular depending skirt 104, which in this example is in the form of a plurality of depending skirt walls 104*a*, 104*b*, and 104*c*, and 104*d* necessitated by the polygonal shape of the base. The wall 104*a* is positioned at a leading end of the connector 46 and the wall 104*b* is positioned at a trailing end. The walls 104*c* and 104*d* define sides of the connector. The height of the annular skirt or side walls 104 creates a bottom well or depression 106 in the connector 46. A plurality of structural ribs 108 extend both longitudinally and transversely across the well 106 to provide additional structural rigidity to the connector 46 while minimizing the weight of the part and the amount of material necessary to form the part. The bottom well 106 and the ribs 108 of the base 100 are shown in simplified form in FIGS. 1 and 2, as well as in greater detail in FIG. 3.

The engaging parts of the connector 46 in this example each include a plurality of discrete engaging or locking pins 110 that extend generally perpendicular from the top wall 102. Each of the locking pins 110 has a narrow stalk section 112 connecting the pin to the base and an engagement head 114 spaced from the top wall by a respective stalk. The transverse width of the stalk essentially corresponds to the width of the connector slot 68 described previously for the channels 50. Similarly, the size and contour of the heads 114 correspond in size and shape to the cross sectional shape of the connector tunnel 70. In the present example, the pins 110 are open at the top and thus have a partly open interior 116 to reduce the weight of the part and to reduce the amount of material needed to fabricate the part.

The pair of engaging parts of the disclosed connector 46 are arranged as a pair of pin rows 120*a* and 120*b* disposed adjacent and arranged along the opposite edges or sides of the connector 46. Each pin row 120 can alternatively be replaced by a unitary elongate structure or engaging part with no discrete segments or pins, if desired. Elongate strengthening ribs 121 are arranged parallel to and spaced apart from one another and extend longitudinally between the discrete pins 110 in each of the rows 120*a* and 120*b*.

Suitable recesses, openings, and the like can be provided such as the openings 122 in the connector 146. Such features may be necessary or advantageous when molding or otherwise forming the connector. As will be evident to those having ordinary skill in the art, the shape, construction, and various features of the pins and base can vary considerably and yet fall within the scope of the present invention.

Figure 8:
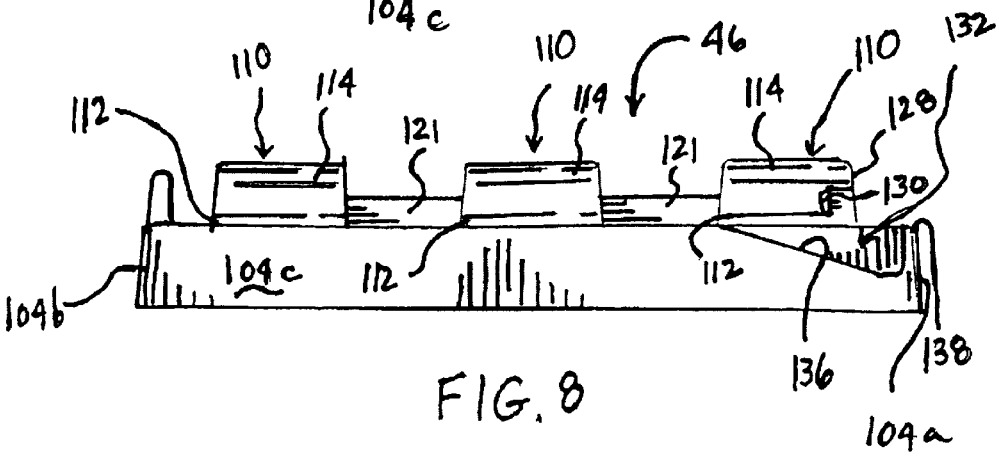
FIG. 8 is a side elevation of one example of a connector constructed in accordance with the teachings of the present invention and illustrated in FIGS. 1–3.
Figure 10:
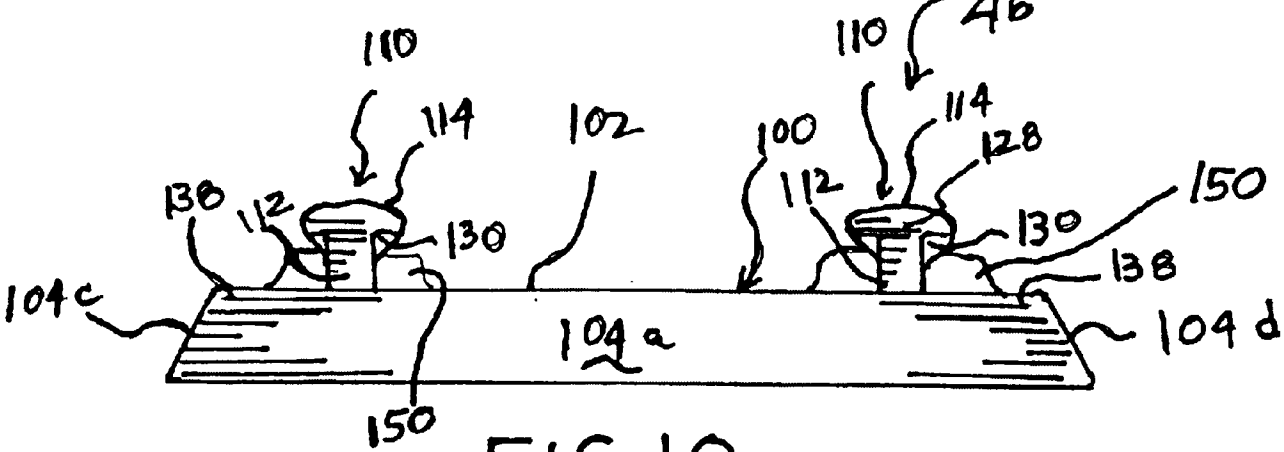
FIG. 10 is a forward end view of the connector shown in FIG. 8.

As shown in FIGS. 8 and 10, a forward or leading end 124 of the connector 46 has additional features that are not found on the trailing or rear end 126 of the connector. For example, the forward facing ends 128 of the forward most pins 110 include notches or cutouts 130. The notches are disposed in a lower portion of the head 114 near the stalk 112. The notches 130 effectively narrow the leading end of each row 120 of pins 110 for ease of installation as described in greater detail below.

Similarly, a recess 132 is provided near each forward corner 134 of the base 100. Each recess 132 has an inclined surface 136 and a front detent barrier wall 138. The recesses 132 are open both to the top wall 102 and the skirt or side walls 104*c* and 104*d*. However, each recess is closed off toward the front wall or skirt 104*a* by a part of the front wall that defines the detente barrier wall 138 for reasons described below.

Figure 11:
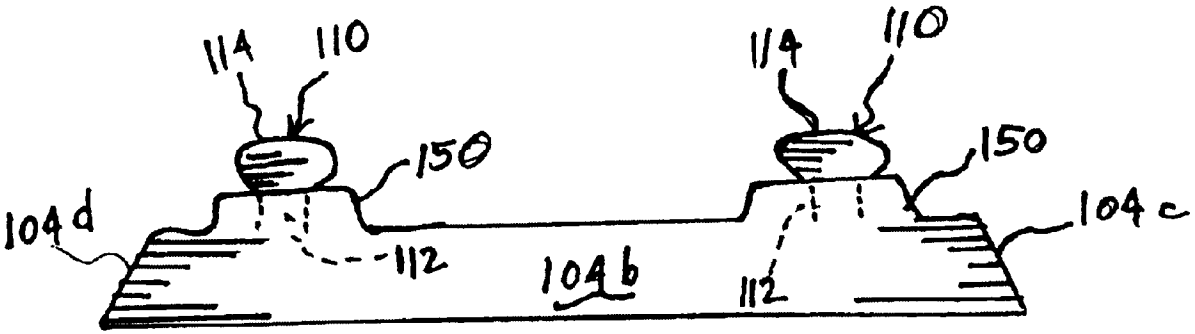
FIG. 11 is a rear end view of the connector shown in FIG. 8.

FIG. 11 simply illustrates a rear elevation of the disclosed exemplary connector 46. The general contour of the pins 110 including the stalks 112 and heads 114 of the trailing pins 110 in each row 120*a* and 120*b* can be seen. One or more upstanding ribs 150 can optionally be placed at the leading end 124, extending from the base 102. One rib 150 is shown in front of each of the engaging pin rows 120. The ribs 150 or other such barrier mechanism can be used to prevent reverse installation of the connector 46, if desired.

Figure 12:
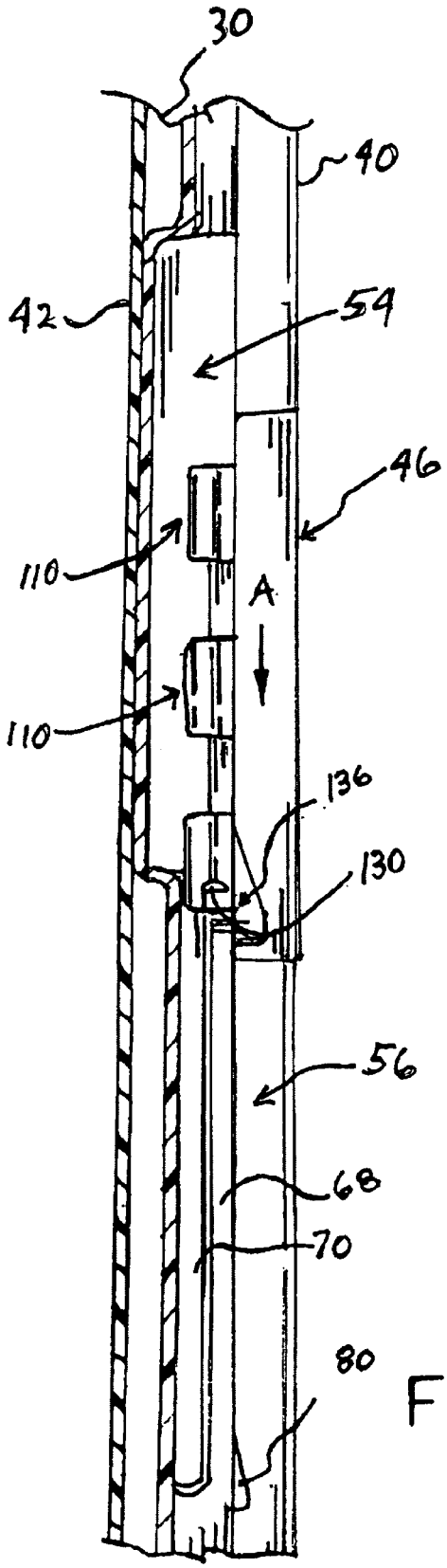
FIG. 12 is a side view in partial longitudinal cross section of the connector channel of FIG. 7 with the connector of FIG. 8 shown just prior to installation.
Figure 13:
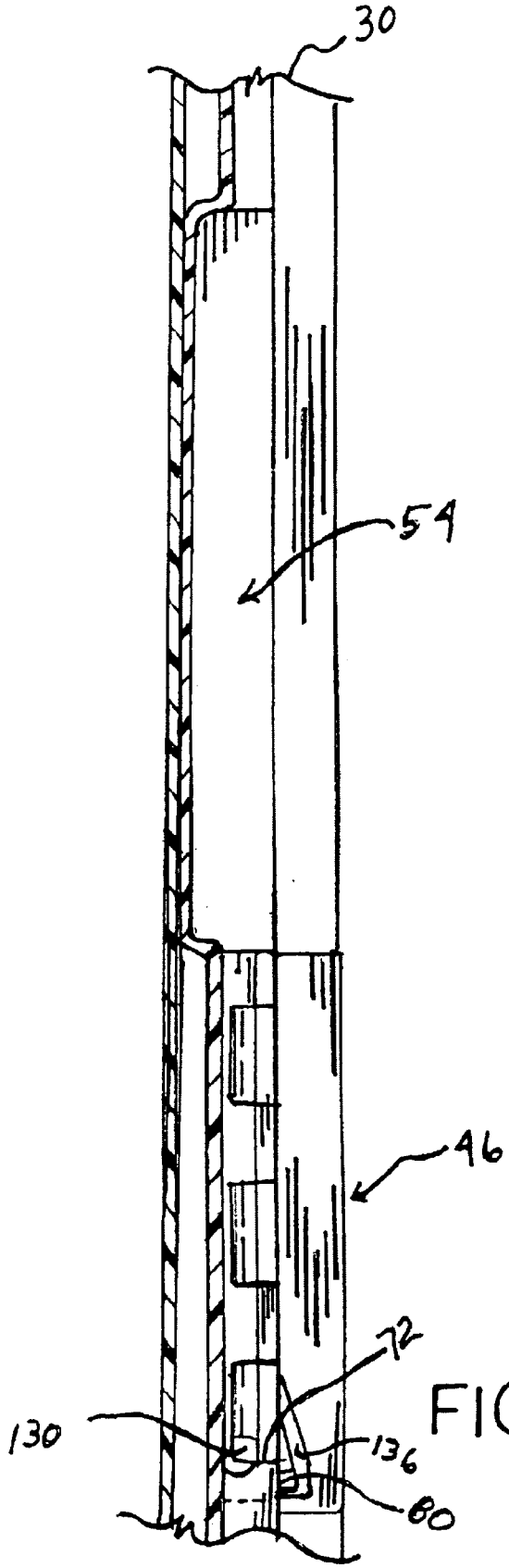
FIG. 13 is a side view of the connector channel shown in FIG. 12 after full installation of the connector.

The procedure for installing a connector 46 in order to interconnect two adjacent panels 30, and the corresponding component features, are now described with particular reference to FIGS. 12 and 13. First, two adjacent panels, such as the panels 30*a* and 30*b*, are oriented and placed with the edges 38*a* and 36*b* (or the edges intended for connection) adjacent one another. The panels are then longitudinally aligned as needed to accommodate and receive the selected connector 46. The lips 60*a* and 60*b* and grooves 62*a* and 62*b* are then interlocked as described above and shown in FIGS. 4 and 5.

A connector 46 is then selected and oriented with the pins 110 facing the profile sides or surfaces 40*a* and 40*b* of the interlocked panels 30*a* and 30*b*. The connector is also oriented such that the connector leading end 124 generally faces toward the connector slot 68 and tunnel 70 into which the connector is to be installed. The pins 110 are then moved directly over the connector channels 50 and 50 of the panels. One row 120*a* of pins 110*a* is inserted into the docking section 54*a* of the channel 50*a* and the other row 120*b* of pins 110*b* is inserted into the docking section 54*b* of the channel 50*b* as shown in FIG. 12. In this pre-installation position, the pins 110 and base 100 essentially float freely within the docking sections 54 of the channels 50. The center part of the connector base wall 102 can be designed rest or bear against portions of the panels 30*a* and 30*b* between the channels 50*a* and 50*b*, if desired. These regions of the panels can be sized to precisely vertically position the connector relative to the depth of the channels.

To complete installation of the connector 46, the connector is moved in the direction of the arrow "A" toward the engaging sections 56*a* and 56*b*, as shown in FIG. 12. The notches 130 on the pin leading ends and the tapered entry 74 into the connector slot 70 each assist in guiding the heads 114 and stalks 112 of the pins 110 into and between edges of the tunnel 70 and slot 68, respectively. The heads 114 are then guided along the tunnel 70 by the close fitting and complimentary relationship between the heads and tunnels. The heads 114*a* move into and along the tunnel 70*a* and the heads 114*b* move into and along the tunnel 70*b*. Similarly, the stalks 112*a* and 112*b* travel along the connector slots 68*a* and 68*b*, respectively. The slot width and stalk width are preferably sized to provide a close fit between the parts.

As the recesses 132 approach the ramps 80, the detente barrier walls 138 ride up the ramp surfaces 82. When the detente barriers 138 reach the forward or front ends 84 of the ramps 80, the barriers 138 snap over the forward ends to capture the ramps in the recesses 132. The angle of the inclined surfaces 136 of the recesses 132 preferably match the angle of the ramp surfaces 82. The detente structure assists in longitudinally holding the connectors in place. The dimensions of the slot 68, stalks 112, tunnels 70, and heads 114 can also be such that static friction created between tightly fitting components also assists in holding the connectors in place. When the connectors 46 are installed, the relatively large size of heads 114 and the narrow width of the slots 68 retain the connectors in the installed position.

The forward ends 84 of the ramps and the inner sides of the detente barriers 138 that face the ramps, when the connector is installed, are preferably drafted, angled, or rounded slightly to assist in removing the connector 46 when desired. To remove the connector, the reverse of the above-described process is performed, but the detente barriers 138 must first snap back over the ramps 80 to accomplish removal.

Figure 14:
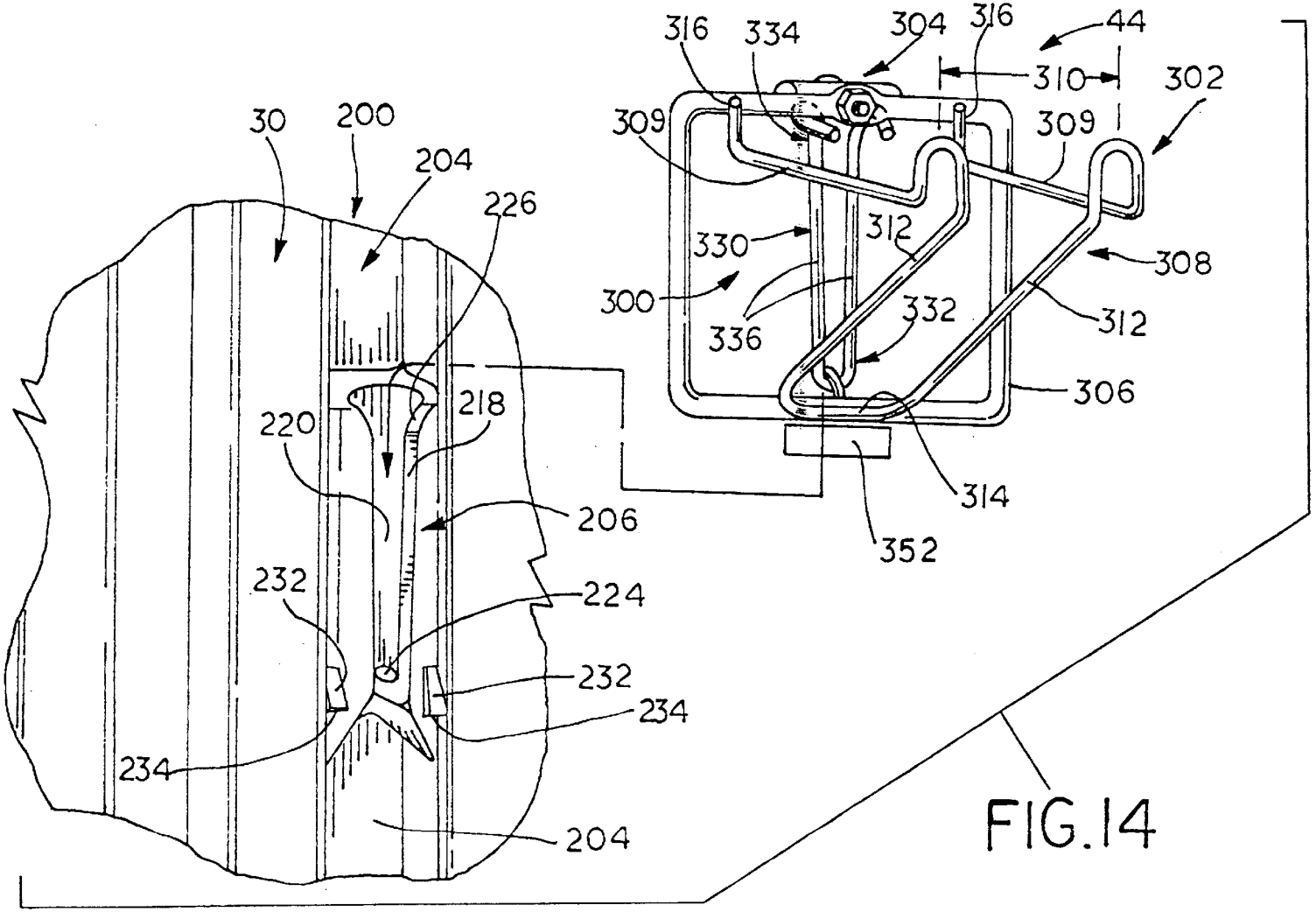
FIG. 14 is an enlarged, exploded, and perspective view of a portion of a panel and one example of an accessory device as shown in FIG. 2 and constructed in accordance with the teachings of the present invention.

An apparatus and method for mounting accessory devices to such panels constructed in accordance with the teachings of the present invention generally includes an accessory device and an accessory interface on a surface of the panel. Referring now to FIGS. 2 and 14, an enlarged view of an accessory interface portion of one of the panels 30 and an accessory device in the form of a hanger 44. As with the panel connecting structure described above, the panel can include one or more accessory interfaces that are adapted to accept and engage with one or more of the accessory devices. In the disclosed example, each panel 30 has a plurality of accessory interfaces in the form of elongate channels 200 arranged longitudinally spaced apart and extending generally vertical along the panels interior to and parallel to the side edges 36 and 38. In alternative examples, one or more of the panel interfaces can be arranged at an angle relative to the illustrated vertical orientation and/or only one accessory interface or only one channel 200 need be provided.

Figure 15:
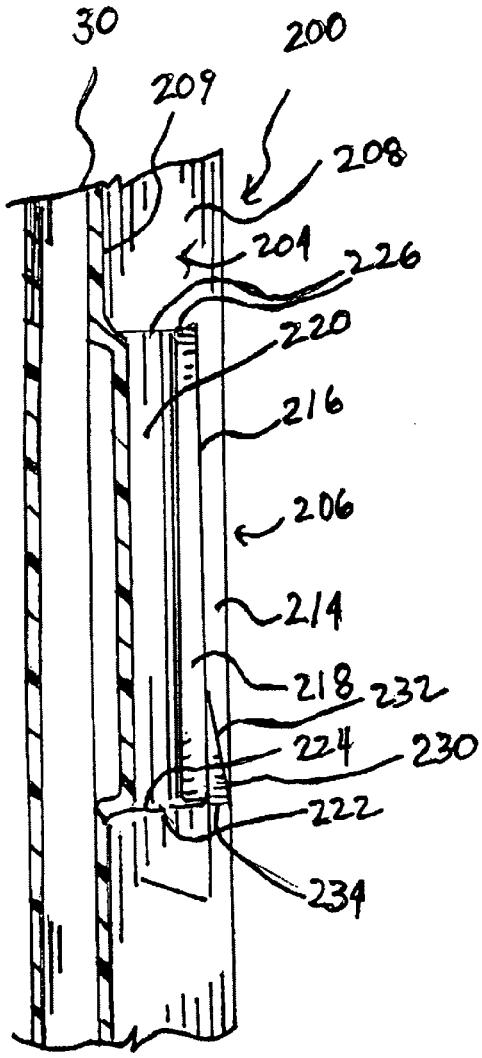
FIG. 15 a longitudinal cross section of an accessory mounting channel of one panel and taken along line XVI—XVI in FIG. 2.

As illustrated in FIGS. 2, 14, and 15, each of the disclosed accessory channels 200 is a continuous elongate channel having a plurality of discrete accessory channel segments 202. In one alternative similar to the connector channels 50 described above, each accessory channel 200 can also be discontinuous or segmented and define intermittent, discrete accessory channel segments 202 that are not provided as part of a continuous channel. In another alternative, an accessory interface or channel 200 may comprise only a single segment 202, as such segments are described herein.

Each accessory channel segment 202 in the disclosed example has an accessory docking section 204 that is adapted for insertion and removal of a portion of the accessory device, or in this example, a hanger 44. Each accessory channel segment 202 also has an accessory engaging section 206 that is adapted for installation of an accessory device 44. Each accessory segment 202 can accommodate mounting of one accessory device in this example and as described below.

Details of the accessory segments 202 and sections 204 and 206 are now described with reference to FIGS. 14–16. FIG. 14 generally shows a channel construction similar to one of the above described connector channels 50. As shown, each accessory docking section 204 of the channel 200 generally has a pair of side walls 208 and a bottom wall 209 that together define a depth and a width intended to easily accommodate insertion therein of a portion of the accessory device 44, as described below. In this example, each docking section 204 also has a length, as can be seen in FIG. 2, that extends between longitudinally adjacent accessory engaging sections 206 of adjacent accessory segments 202 in the channel 200. As discussed above, each accessory docking section 204 need not extend continuously to another accessory segment, but instead can terminate at a discrete segment end (not shown) spaced from other accessory segments 202, if desired. In any case, each accessory docking section 204 has a length, width, and depth combination that permits insertion of a part of the accessory device 44 into the docking section to facilitate proper installation and engagement between the device and the accessory interface.

FIG. 15 illustrates a longitudinal cross section along a portion of one of the accessory interfaces or channels 200, prior to installation of an accessory device 44, and illustrates the accessory engaging section 206 and portions of adjacent docking sections 204. Each accessory engaging section 206 in this example is axially aligned with the channel 200. Where only discrete segments 202 are utilized (i.e. no channel 200), each engaging section will at least be axially aligned with its respective docking section 204. In this example, each engaging section 206 has side walls 214 of a shallower depth than the side walls 208 of the docking section 204. The side walls 214 terminate at a generally planar bearing surface 216. In this example, an elongate accessory slot 218 is provided in the bearing surface 216 and extends axially along the length of the accessory engaging section 206. The accessory slot 218 opens into and provides access to an accessory latching tunnel 220 axially aligned with the slot. The width of the accessory slot 218 is narrower than the width of the accessory latching tunnel 220 for reasons described below.

One end 222 of the accessory latching tunnel narrows to define an accessory stop surface 224 that limits travel along the tunnel of the accessory device when installed. In one example, this end 222 of the tunnel 220 can be a blind end instead of a narrowed open end. The opposite end of the accessory tunnel 220 and the accessory slot 218 can be tapered slightly radially outward, as shown, to define an entry opening 226 into the accessory slot and latching tunnel.

The accessory interface of the panels 30 can also include a detent mechanism to provide a positive and fully installed feel or indication for the accessory device 44. Such a detent mechanism can also assist to hold the accessory device in the installed position. In the disclosed example, and similar to the panel connector apparatus described above, a detent ramp 230 is positioned on a top side of at least one of the bearing surfaces 216 adjacent the accessory slot 218. In the disclosed example, one ramp 230 is positioned on each side of the accessory slot 218. Each of the ramps 230 as shown are located near the forward, narrowed end 222 adjacent the accessory stop surfaces 224 of the accessory tunnel 220 and the slot 218. However, the ramps 230 can be positioned anywhere along the bearing surfaces 216 and yet provide the attendant function. In addition, the detent feature can be provided with an alternative construction and yet perform the same function when installing the accessory device 44 as described below.

Each of the detent ramps 230 disclosed herein has an inclined ramp surface 232 that can be inclined at a desired angle to render installing the accessory device relatively easy and yet adequately provide the detent or "positive home" feel when the accessory device is installed. As with the ramps 80 described above, each of the detent ramps 230 terminates at its inclined end at a front end 234.

Details of one example of an accessory device in the form of the hanger 44 are now described with periodic reference to FIGS. 14–20. The device 44 generally has an engaging part 300 that engages with the accessory interface of the panel 30, and has a body or utility part 302 which generally produces the desired utility for the device 44. In the disclosed example, the accessory device 44 is in the form of a bent wire hanger assembly wherein the body or utility part 302 is adapted to hang or support objects from a sturdy wire structure. However, the utility part 302 can be adapted to support separate a shelf, can be formed as an integral shelf, or can be adapted to perform other useful functions as desired. The particular utility or function of the utility part 302 can vary considerably and yet fall within the spirit and scope of the invention.

With that in mind, the utility part 302 has a coupling section 304 which connects the utility part and the engaging part 300. In the disclosed example, the utility part 302 has a base or support section 306 providing structural rigidity to the device 44 and a wire hanger section 308 for supporting an object. The hanger section 308 in this example has a pair of spaced apart horizontal wires 309 that extend forward from the support section 306 and that define a gap 310 between them. A pair of suitably bent support wires 312 extend one each at an angle from respective distal ends of the hanger wires 309. In this example, the support wires are curved or bent and meet at a joint 314 fixed to a part of the support section 306. Proximal ends of the horizontal hanger wires 309 are suitably joined to an upper end of the mounting section 306 at separate joints 316. In this example, the wire mounting section 306 and hanger section 308 of the utility part 302 are formed from steel or a suitable metallic material and the joints 314 and 316 between the mounting section and hanger section are weld joints.

As illustrated, the mounting section 306 is a single wire shaped or formed in a rectangular configuration. The hanger section 308 is a single wire bent to form the angled support wires 312 and the horizontal wires 309. As will be evident to those having ordinary skill in the art, the wire structure can be formed or bent to virtually any desired configuration and yet provide some utility as a utility part 302. Similarly, other materials and constructions are also possible. For example, instead of using wire, the utility section 302 can be formed from molded plastic materials, sheet metal, or the like and include simple or complex surfaces that provide the desired utility as well as other shapes and configurations to provide structure and rigidity for the part.

To illustrate, the utility part 302 in this example provides an upper resting surface defined by the spaced apart horizontal wires 309 on which parts of an object can be rested. For example, a shovel or a rake handle can be placed in the gap between the horizontal wires 309 with the shovel or rake head resting on and supported by the wires 309. Alternatively, each horizontal wire 309 and its respective support wire 312 can define a separate hook for hanging an object such that one or more objects can be supported by each discrete hook. Many other configurations and constructions are certainly possible. The utility part 302 can also be in the form of a single hook or a single horizontal support surface (see FIG. 21 and description below) for supporting objects.

As shown in FIGS. 17–20, in order to attach the utility part 302 to a panel 30, the engaging part 300 is provided on a side opposite the side adapted to support objects and attached to the utility part 302 at the connection 304. In this example, the engaging part 300 is an elongate blade 330 that extends generally parallel to a back side or surface of the utility part 302. In this example, the blade 330 is spaced from the utility part. The blade 330 has a length and a width that generally correspond with the length and width of the accessory latching tunnel 220. The blade 330 terminates at a distal end 332 and has a proximal end 334 that is coupled to the connection 304.

The structure and nature of the engaging part 300 can vary considerably and yet fall within the scope of the present invention. In this example, the blade is in the formed from bent wire with two elongate parallel wire segments 336 that are joined at the distal end 332. In alternative examples, the blade can be formed as a solid part from molded plastic, metal, or the like. The size and shape of the blade can vary considerably and yet fall within the scope of the present invention. The blade 330 is preferably complimentary to the accessory latching tunnel. The engaging part 300 need not be in the form of a blade 330, but instead can be in other elongate forms (see FIG. 21 and description below) without departing from the spirit and scope of the invention.

The connection 304 between the engaging part 300 and the utility part 302 can also vary. It can be a fixed, welded connection between metal or plastic parts. It can alternatively be an integrally formed plastic interconnection between the parts sections. It can also be a tightly or loosely fastened connection between the sections, as in this example. As shown herein, the proximal ends of the wire segments 336 are angled, in this example, generally perpendicular to the wire segments 336 and form legs 338 extending from the segments. A transverse bar 340 is connected to both of the legs 338 and extends between the legs. A bore is formed in the connector bar 340 generally perpendicular to the bar and the segments 336. A complimentary bore 344 is formed in the upper end of the mounting section 306 of the utility part. One of the bores can be threaded to engage a traditional fastener. Alternatively, a nut and bolt arrangement can also be used, as in this example. A shown, a conventional threaded fastener 346 is passed through each of the bores 342 and 344 to interconnect the engaging part to the utility part and a nut 348 secures the fastener in place.

As noted above and shown in FIG. 20, the connection 304 between the engaging part 300 and the utility part 302 can be designed to provide limited play so that the angle of the engaging part 300 can vary by at least a small amount relative to the utility part 302. As illustrated, the engaging part can pivot about the proximal end 334 so that the distal end can move relative to the mounting section, if desired. Such play can be provided in order to facilitate relatively easy installation and removal of the accessory device 44 from the panel interface or accessory channel 200. However, no such play is necessary and the engaging part 300 and utility part 302 can be rigidly fixed relative to one another.

Figure 19:
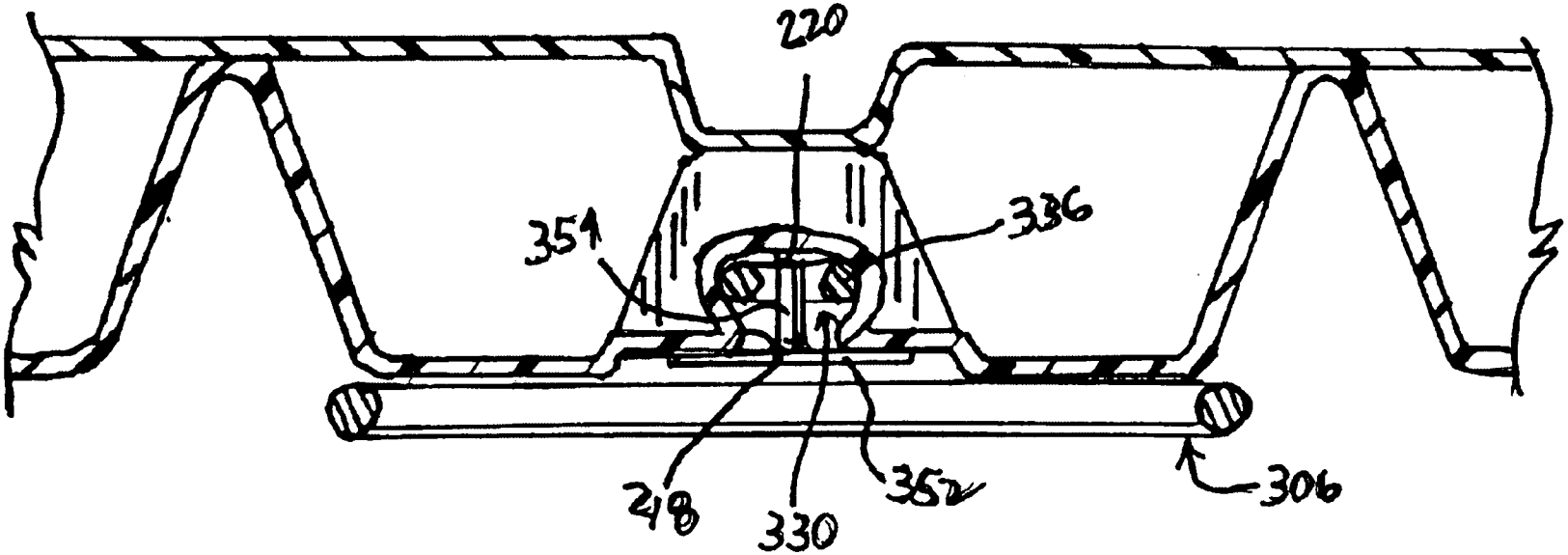
FIG. 19 is a top view in cross section of the accessory channel and accessory device and taken along line XIX—XIX in FIG. 17.
Figure 20:
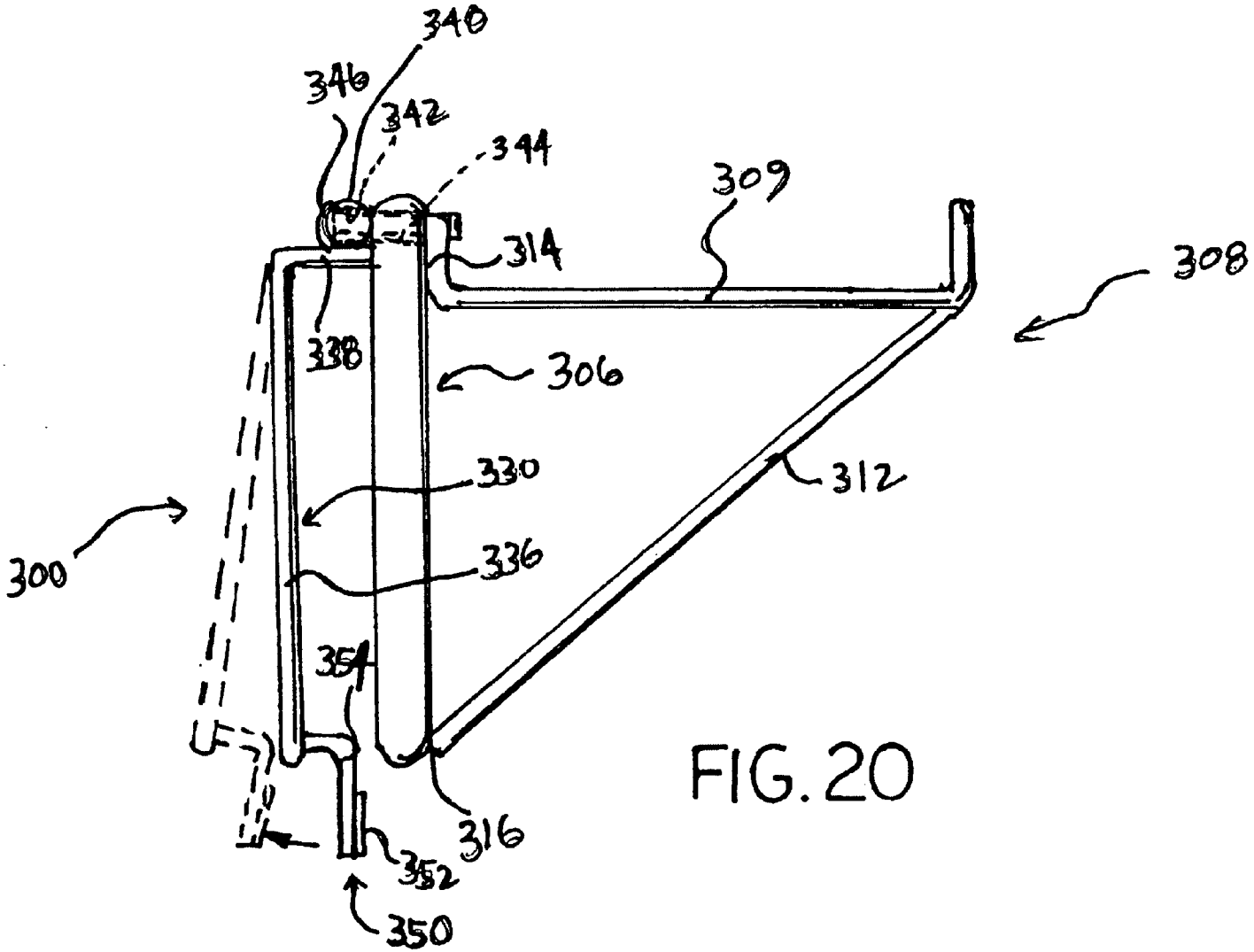
FIG. 20 is a side view of one example of an accessory device constructed in accordance with the teachings of the present invention.

As shown in FIGS. 19 and 20, a detente tab 340 is provided extending perpendicularly from the distal end 334 of the blade 330. The detent tab 340 has a transverse bar 342 extending laterally and generally parallel relative to the blade 330. The detente bar 342 is secured to the blade by a stem 344 attached to and projecting from the blade 330.

Figure 16:
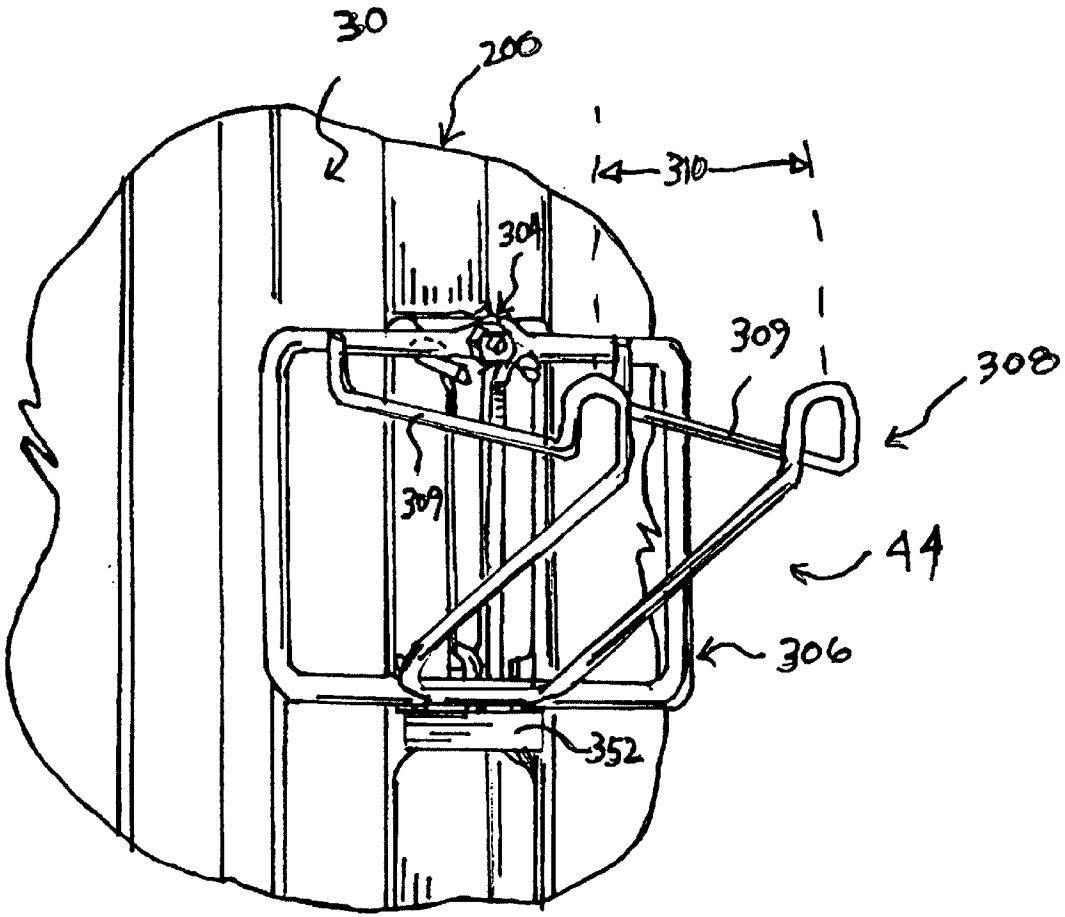
FIG. 16 is an enlarged perspective view of a portion of the panel and the installed accessory device as shown in FIG. 1.
Figure 17:
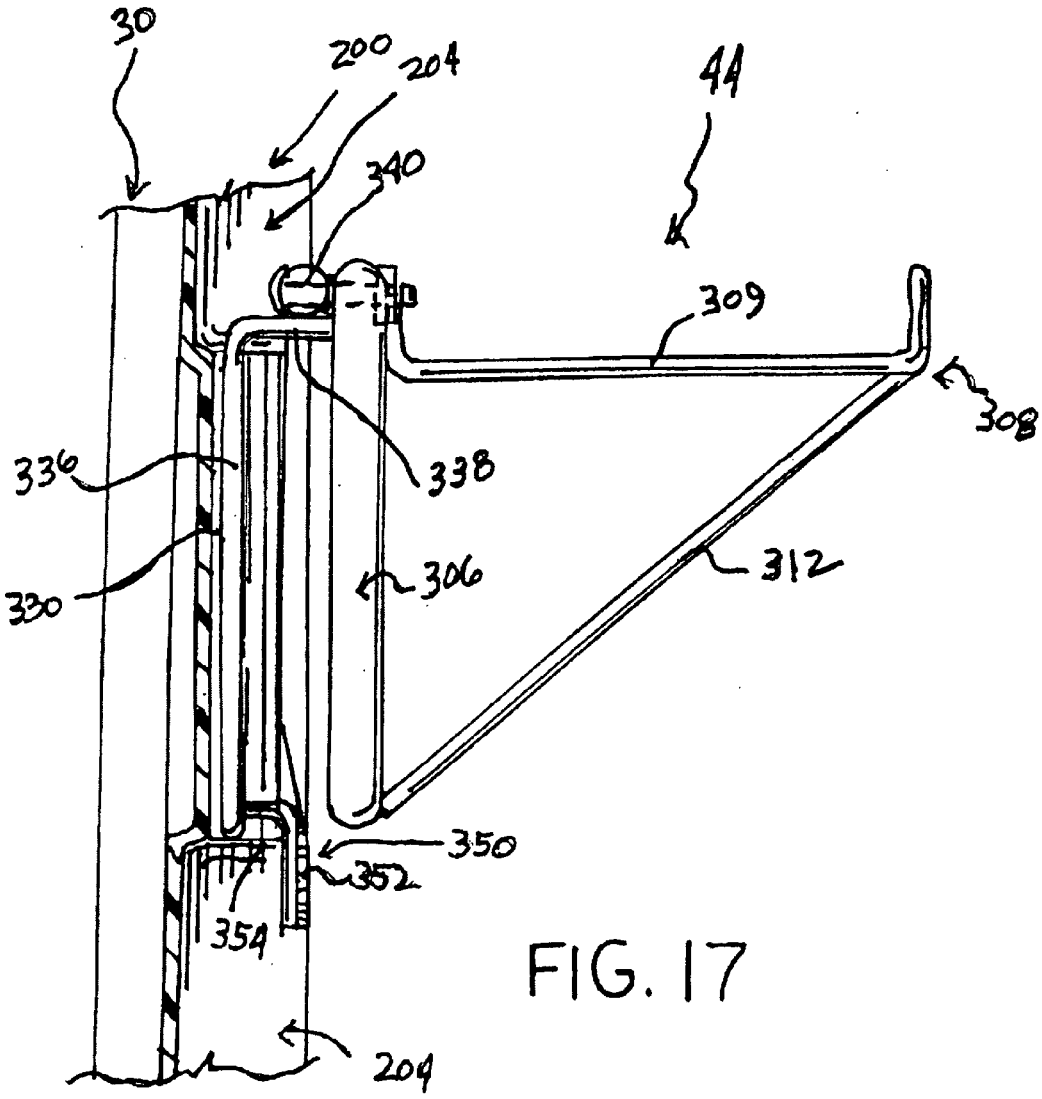
FIG. 17 is a side view in partial cross section of the accessory channel of FIG. 16 and after installation of the accessory device.
Figure 18:
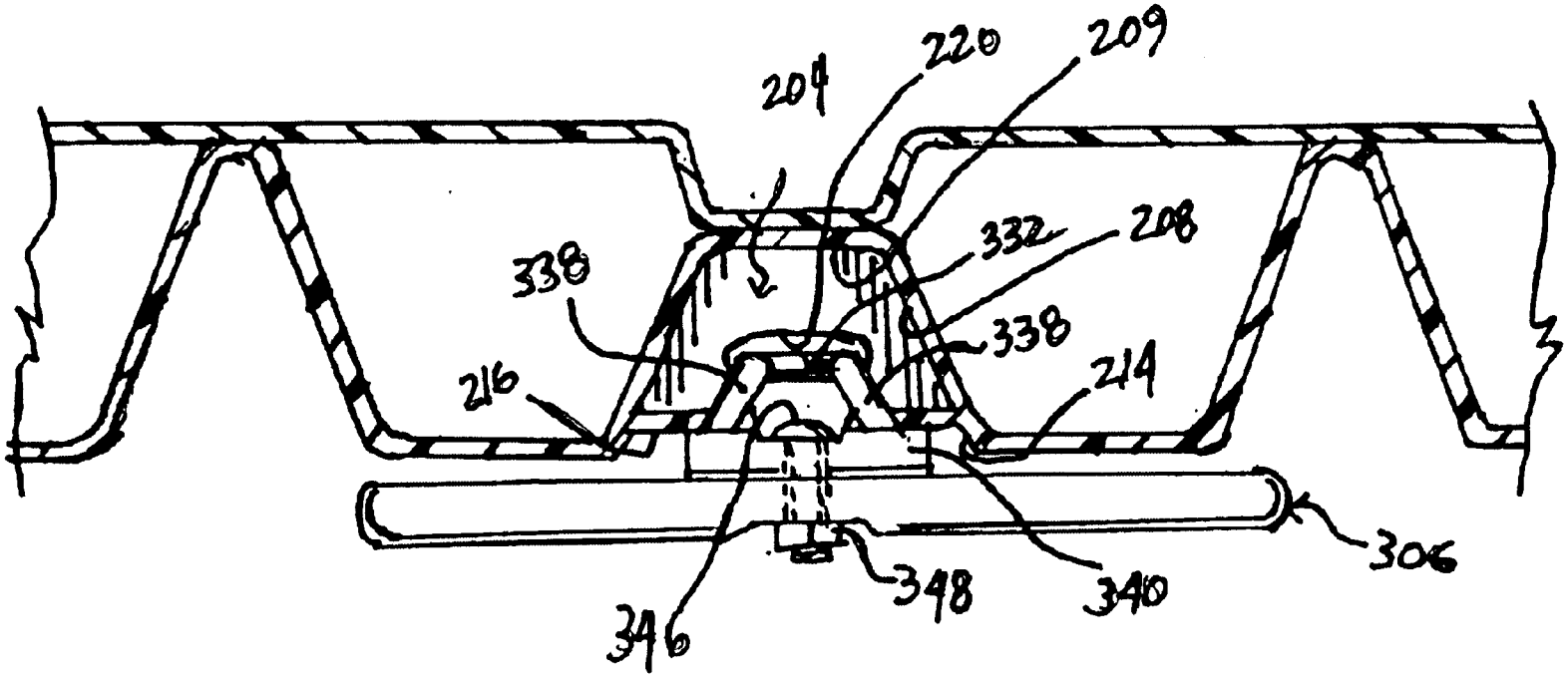
FIG. 18 is a top view in cross section of the accessory channel and accessory device and taken along line XVIII—XVIII in FIG. 17.

Referring now to FIGS. 14, 16, and 17, installation of the accessory device or hanger 44 is now described. A desired device is selected, such as the hanger 44 and is placed into the profile side 40 of any one of the panels 30 at the desired location. The engaging section 300 (here, the blade 330) is inserted into the selected accessory docking section 204 with the distal end 334 facing the entry opening 226. The engaging section 300 is then slid into the latching tunnel 220 until the distal end bears against the stop surface 224. The stem 344 passes along the accessory slot 218 with the detente bar riding adjacent the bearing surfaces. The bar 342 rides up the ramp surface 332 of the detente ramps 230 until the bar "snaps" over the ramps and rests adjacent the forward ends 234 of the ramps. This is the "positive home" position of the detente mechanism.

In this example, the accessory slot is provided for the detente mechanism 340. If an alternative detente mechanism were provided, such as within the accessory latching tunnel 220, no slot need be provided. The blade 330 could slide into a blind tunnel in the panel in such an example. A bump or protrusion within the tunnel 220 could engage the wire at the distal end 334 of the blade to provide the detente or "positive home" feel, for example.

Figure 21:
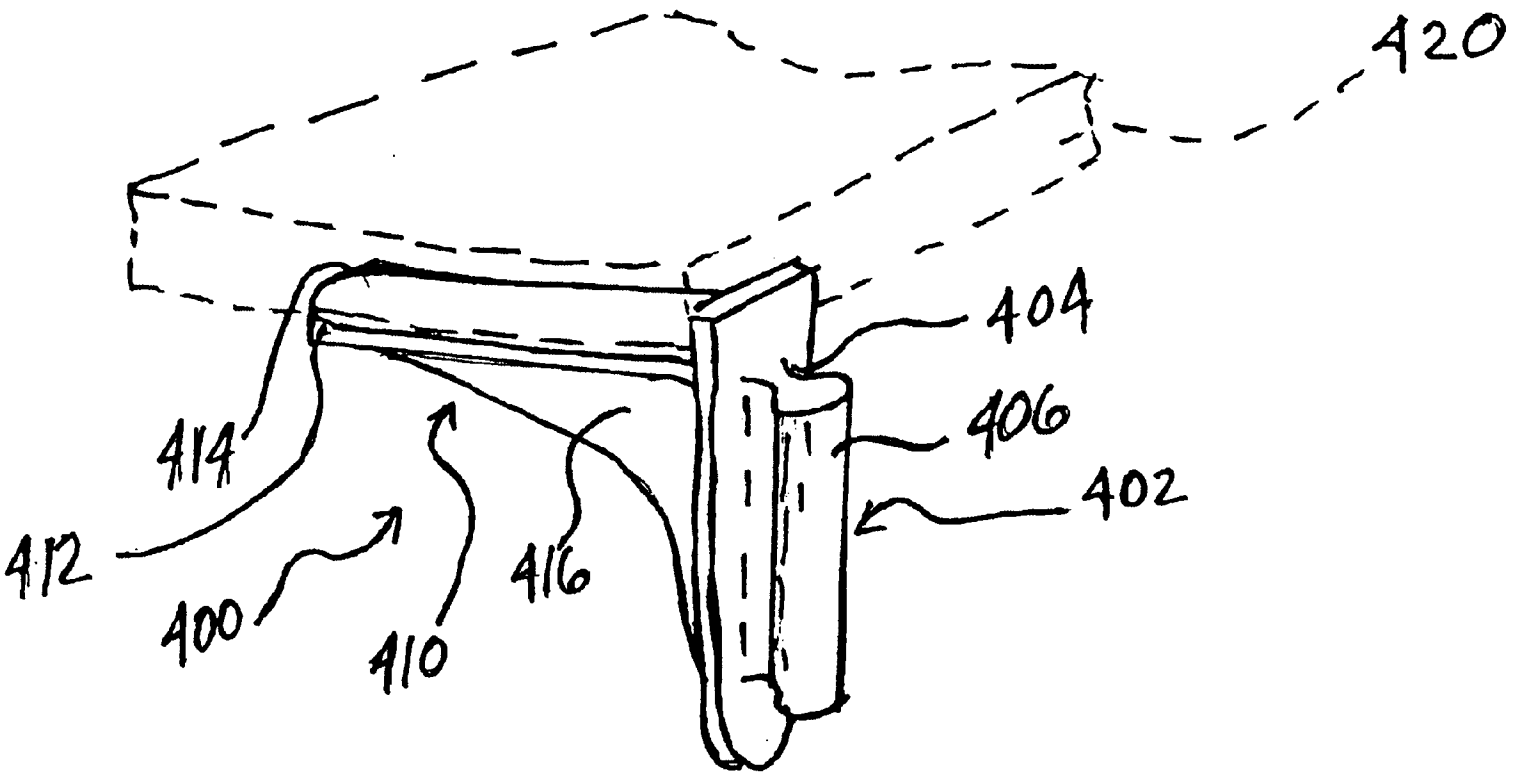
FIG. 21 is a side view of another example of an accessory device constructed in accordance with the teachings of the present invention.

Though one example of an accessory device in the form of a hanger 44 is illustrated and described herein, as will be evident to those having ordinary skill in the art, many modifications and changes to the disclosed device 44 can be made without departing from the spirit and scope of the present invention. For example, FIG. 21 illustrates an accessory device 400 in the form of a shelf support. The device 400 also is illustrated utilizing an engaging part 402 similar to that of the connector 46 disclosed herein. The engaging part 402 includes a single elongate "pin" instead of the three aligned pin configuration disclosed above. The engaging part in this example has a stalk portion 404 and a wider head portion 406. The stalk portion slides along the accessory slot 218 and head portion 406 slides into the tunnel 220 in this example. The device 400 has a utility part 410 having a forwardly extending support 412 with an upper surface 414. A rib 416 lying under the support 412 provides structural rigidity for the device.

In this example, a part of a shelf 420 rests on the upper surface 414. The support 412 can be provided with a means to secure the shelf in place, such a fastener opening or a snap-in feature, as desired. Alternatively, and as mentioned above, the shelf 420 can be an integrally molded or formed part of the device 400. Any accessory device that can be mounted to a panel and provide some utility is intended to be encompassed by the scope of the present invention.

Various dimensions for certain parts of the apparatuses described herein can be selected and manipulated to achieve desired functional characteristics. For example, portions of the panels 30, connectors 46, and accessory devices 44 can be designed to create slight interference fits or slight loads at points within the apparatus. The pins, blades, engaging parts, and/or the tunnels and slots can be appropriately spaced to draw the engaged components slightly together or force them slightly apart when installed. Such a slight interference between the installed or assembled components can be utilized to create a fairly rigid joint or to form a seal at the lip and groove joint of adjoined panels. Similarly, the detente barriers, ramps, and/or other elements can also be varied to achieve certain functional characteristics. Also, the tunnel, head, stalk, bladed, and slot sizes, and shapes, and positions can be designed to create desired characteristics. As an example, the engaging parts such as the pins can be formed progressively larger, moving from the leading end to the trailing end of the connector 46. The blade width can be similarly varied.

The disclosed panels 30 are particularly well suited for the method and apparatus. The panels are hollow panels with space between the profile sides 40 and decorative sides 42. Molding tools and operations can be utilized to form a wide variety of shapes and features into the panels. Points where the profiles side 40 and decorative side 42 are joined (called "tack offs"—see FIG. 12 at the bottom 59 of the docking section 54) can be created to provide strength enhancing characteristics as well as other features.

Although certain methods and apparatuses have been disclosed and described herein in accordance with the teachings of the present invention, the scope of coverage of this patent is not limited thereto. On the contrary, this patent covers all embodiments of the teachings of the invention fairly falling within the scope of the appended claims, either literally or under the doctrine of equivalents.

What is claimed is:

1. An apparatus for mounting accessories to a panel surface, the apparatus comprising:

a profile side on the panel;

at least one accessory interface defining an elongate engaging section recessed within and lying generally parallel to apart of the profile side;

the accessory interface further comprising an elongate accessory channel segment defining both the engaging section and an axially aligned docking section which is sized and shaped to accommodate initial insertion of an elongate engaging part into the accessory channel segment before being moved to an installed position in the engaging section wherein the engaging section has side walls of a shallower depth than side walls of the docking section, the side walls of the engaging section terminating at a generally planar bearing surface;

an accessory device having a body including a utility part and having an elongate engaging part coupled to the body, wherein the engaging part can be slidably moved to an installed position in the engaging section of the accessory interface; and at least one elongate accessory channel extending along a part of the profile side and including a plurality of the accessory channel segments axially aligned along the at least one accessory channel.

2. An apparatus according to claim 1, wherein the engaging section of the panel has an elongate accessory tunnel with an axis and a tunnel width sufficient to slidably accept the engaging section within the accessory tunnel.

3. An apparatus according to claim 2, wherein the engaging section of the panel has an accessory slot that is oriented parallel to the tunnel axis and is open to the profile side and opens into the accessory tunnel, and wherein the accessory slot has a slot width smaller than the tunnel width.

4. An apparatus according to claim 1, further comprising:

a plurality of the accessory channels arranged spaced apart over the profile side.

5. An apparatus for mounting accessories to a panel surface, the apparatus comprising:

a profile side on the panel;

at least one accessory interface defining an elongate engaging section recessed within and lying generally parallel to a part of the profile side;

the accessory interface further comprising an elongate accessory channel segment defining both the engaging section and an axially aligned docking section which is sized and shaped to accommodate initial insertion of the engaging part into the accessory channel segment before being moved to the installed position in the engaging section;

an accessory device having a body including a utility part and having an elongate engaging part coupled to the body, wherein the engaging part can be slidably moved to an installed position in the engaging section of the accessory interface;

the engaging section of the accessory channel segment further comprising an engaging tunnel extending longitudinally along the accessory channel segment and having a tunnel shape, a tunnel length, and a tunnel width that are complimentary to a length, shape, and width of the engaging part when in the installed position.

6. An apparatus according to claim 5, wherein the engaging section lies generally parallel to a plane of the panel.

7. An apparatus according to claim 5, wherein the profile side is provided on a plastic panel formed as a one-piece integral structure.

8. An apparatus according to claim 7, wherein the plastic panel is a blow molded panel with one or more hollow regions between the profile side and a side opposite the profile side.

9. An apparatus according to claim 5, wherein the profile side of the panel has a varied surface profile that integrally defines the accessory interface.

10. An apparatus according to claim 5, further comprising:

a plurality of the accessory channel segments arranged over the profile side.

11. An apparatus according to claim 5, wherein the engaging section of the accessory channel segment further comprises:

an accessory slot extending generally parallel to the channel and opening into the engaging tunnel and having a slot width that is smaller than the tunnel width; and an entry opening at an end of both the engaging tunnel and the accessory slot adjacent the docking section permitting installation of the engaging part via the entry opening.

12. An apparatus according to claim 5, wherein the accessory interface includes at least one detente mechanism that engages with a part of the accessory device when the accessory device is in the installed position.

13. An apparatus according to claim 12, wherein the engaging part of the accessory device further comprises:

at least one elongate projection extending from the accessory device, the projection having a stalk coupled to and extending from the body and having a stalk width; and a head carried on the stalk and spaced from the body, wherein the head has a head width that is larger than the stalk width.

14. An apparatus according to claim 13, wherein the elongate projection is formed from a row of aligned pins each having such a head and stalk.

15. An apparatus according to claim 5, wherein the engaging part comprises:

an elongate blade having one end coupled to a portion of the accessory device.

16. An apparatus according to claim 5, wherein the accessory device is molded from a high density thermoplastic material.

17. An apparatus according to claim 5, wherein the accessory device is formed from a metal.

18. An apparatus according to claim 17, wherein the metal accessory device is fabricated from wire formed to configure both the engaging part and the utility part.

19. An apparatus for mounting accessories to a panel surface the apparatus comprising:

a profile side on the panel;

at least one accessory interface defining an elongate engaging section recessed within and lying generally parallel to a part of the profile side;

an accessory device having a body including a utility part and having an elongate engaging part coupled to the body, wherein the engaging part can be slidably moved to an installed position in the engaging section of the accessory interface;

the accessory interface including at least one detent mechanism that engages with a part of the accessory device when the accessory device is in the installed position; the detent mechanism including:

a ramp provided on a part of the accessory interface; and a detent part on a portion of the accessory device that engages with the ramp when the connector is being moved to the installed position.

20. An apparatus according to claim 19, wherein the accessory interface further comprises:

an elongate accessory channel segment defining both the engaging section and an axially aligned docking section which is sized and shaped to accommodate initial insertion of the engaging part into the accessory channel segment before being moved to the installed position in the engaging section.

21. A method of mounting accessories to panel surfaces, the method comprising the steps of:

providing a panel with a surface having at least one accessory interface defining an elongate engaging section recessed within and lying generally parallel to a part of the profile side;

providing at least one elongate accessory channel segment in the panel surface that defines both the engaging section and an axially aligned docking section, the at least one elongate accessory channel extending along a part of the panel surface wherein the engaging section has side walls of a shallower depth than side walls of the docking section, the side walls of the engaging section terminating at a generally planar bearing surface;

providing an accessory channel including a plurality of the accessory channel segments axially aligned along the at least one accessory channel;

selecting at least one an accessory device having a body with a utility part and having an elongate engaging part coupled to the body;

inserting a portion of the engaging part into the accessory interface; and sliding the accessory to an installed position with the engaging part in the engaging section of the accessory interface.

22. A method according to claim 21, wherein the step of sliding the accessory further comprises:

sliding the accessory device until a detente mechanism engages between the part of the accessory device and part of the panel interfaces.

23. A method according to claim 21, wherein the step of sliding further comprises:

sliding the engaging part from a docking section of the panel interface into the engaging section.

24. A method according to claim 21, wherein the step of inserting further comprises:

inserting the engaging part into a docking section of the panel interface adjacent the engaging section.

25. A method according to claim 21, wherein the step of sliding further comprises:

sliding the engaging part into an elongate accessory tunnel of the engaging section.

26. A method according to claim 21, wherein the step of sliding further comprises:

sliding a portion of the engaging part having a first width into an elongate accessory tunnel of the engaging section and sliding a portion of the engaging part having a second width smaller than the first width along an accessory slot that is oriented parallel to the accessory tunnel and that is open to the panel surface and into the accessory tunnel.

27. A method according to claim 21, further comprising the step of:

blow molding the plastic panel with one or more hollow regions between a profile side defining the panel surface and a side opposite the profile side.

28. A method according to claim 21, wherein the step of inserting further comprises initially inserting the engaging part into the docking section of the accessory channel segment before the stop of sliding.

29. A method according to claim 21, further comprising:

providing a plurality of the accessory channel segments arranged over the panel surface.

30. A method according to claim 21, further comprising the step of:

selecting one of the plurality of accessory channels before the step of inserting.

31. A method according to claim 21, further comprising:

providing a plurality of the accessory channels arranged spaced apart over the panel surface.

32. A method according to claim 21, further comprising the stop of:

securing apart of a shelf to the utility part of the accessory device after the step of sliding.

33. A method according to claim 21, further comprising the steps of:

selecting a second accessory device and repeating the steps of inserting and sliding; and securing a shelf to the utility parts of the accessory devices.

34. A method according to claim 22, further comprising the step of:

hanging an object from the utility part of the accessory device.

35. An apparatus for mounting objects to a panel surface, the apparatus comprising:

a panel defining the panel surface;

a plurality of accessory channel segments axially aligned and extending along, recessed within and lying generally parallel to a part of the panel surface, each of the segments defining both an engaging section and an axially aligned docking section, the engaging section including an accessory stop surface wherein the engaging section has side walls of a shallower depth than side walls of the docking section, the side walls of the engaging section terminating at a generally planar beaning surface; and an accessory device having a utility part adapted to support an object and having an elongate engaging part coupled to the accessory device, wherein the engaging part can be initially inserted in the docking section and then slidably moved to an installed position in the engaging section of a selected one of the plurality of accessory channel segments such that the engaging part is prevented from pulling out of the selected accessory segment in a direction normal to the panel surface.

36. An apparatus according to claim 35, wherein the accessory channel further comprises:

a docking section axially aligned with the accessory tunnel, the docking section adapted to receive the engaging section within the panel surface adjacent the engaging section.

37. An apparatus according to claim 35, wherein the utility part is a shelf support.

38. An apparatus according to claim 35, wherein the utility part is a support hook.

39. An apparatus according to claim 35, wherein the utility part has a pair of horizontally arranged supports defining a gap therebetween.

40. A modular plastic panel and accessory device combination comprising:

at least one panel surface;

a plurality of axially aligned accessory tunnels formed recessed in a part of the panel surface and oriented generally parallel to a plane of the panel, each of the tunnels having both an engaging section and an axially aligned docking section, the engaging section including an accessory stop surface wherein the engaging section has side walls of a shallower depth than side walls of the docking section, the side walls of the engaging section terminating at a generally planar bearing surface; and an accessory device having a utility part for supporting objects and an elongate engaging part initially inserted in the docking section and then slidably received in the engaging section of a selected one of the accessory tunnels, the engaging part being prevented from being removed from the selected accessory tunnel in a direction generally normal to a plane of the panel.

* * * * *